US007063201B2

(12) United States Patent
Nakamura et al.

(10) Patent No.: US 7,063,201 B2
(45) **Date of Patent: *Jun. 20, 2006**

(54) POWER TOOL AND SPINDLE LOCK SYSTEM

(75) Inventors: Daijiro Nakamura, Hyugo (JP); Robert W. Klemm, Colgate, WI (US)

(73) Assignee: Milwaukee Electric Tool Corporation, Brookfield, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/796,355

(22) Filed: Mar. 9, 2004

(65) Prior Publication Data

US 2004/0231952 A1 Nov. 25, 2004

Related U.S. Application Data

(63) Continuation-in-part of application No. 10/096,441, filed on Mar. 12, 2002, now Pat. No. 6,702,090, which is a continuation-in-part of application No. 09/995,256, filed on Nov. 27, 2001, now abandoned.

(30) Foreign Application Priority Data

Mar. 5, 2004 (JP) ..... 2004-061933

(51) Int. Cl.
*B25B 21/00* (2006.01)

(52) U.S. Cl. ..... 192/223.1; 173/217

(58) Field of Classification Search ..... 192/223.1, 192/223.2, 38; 173/216, 217
See application file for complete search history.

(56) References Cited

U.S. PATENT DOCUMENTS

| | | | |
|---|---|---|---|
| 1,503,809 | A | 8/1924 | Schulz et al. |
| 3,243,023 | A | 3/1966 | Boyden |
| 3,545,776 | A | 12/1970 | Haviland |
| 3,872,951 | A | 3/1975 | Hastings, Jr. |
| 4,173,849 | A | 11/1979 | Mar |
| 4,199,160 | A | 4/1980 | Bent |
| 4,390,311 | A | 6/1983 | Kuhlmann |
| 4,407,615 | A | 10/1983 | Kuhlmann |
| 4,460,296 | A | 7/1984 | Sivertson, Jr. |
| 4,498,682 | A | 2/1985 | Glore |
| 4,573,380 | A | 3/1986 | Bald |

(Continued)

FOREIGN PATENT DOCUMENTS

| | | |
|---|---|---|
| CA | 2092018 | 3/1994 |

(Continued)

OTHER PUBLICATIONS

Advertisement for Milwaukee Electric Tool Corp. "Cordless 2.4 Volt Screwdrivers," published prior to Nov. 2001.

(Continued)

*Primary Examiner*—Richard M. Lorence
(74) *Attorney, Agent, or Firm*—Michael Best & Friedrich LLP

(57) ABSTRACT

A power tool and spindle lock. The spindle lock includes a spring and a detent arrangement to control and buffer the rotation of the spindle and to delay the engagement of the locking elements. In some aspects, the invention provides a spindle lock including a spring element which applies substantially equal spring force to delay the operation of the spindle lock when the spindle is rotated in the forward direction or in the reverse direction. In some aspects, the invention provides two spring members which cooperate to apply the substantially equal force to delay the operation of the spindle lock when the spindle is rotated in the forward direction or in the reverse direction.

20 Claims, 32 Drawing Sheets

U.S. PATENT DOCUMENTS

| | | | |
|---|---|---|---|
| 4,582,331 | A | 4/1986 | Röhm |
| 4,695,065 | A | 9/1987 | Komatsu et al. |
| 4,775,269 | A | 10/1988 | Brix |
| 4,804,048 | A | 2/1989 | Porth, Jr. |
| 4,819,319 | A | 4/1989 | Röhm |
| 4,824,298 | A | 4/1989 | Lippacher et al. |
| 4,834,192 | A | 5/1989 | Hansson |
| 4,848,779 | A | 7/1989 | Wheeler et al. |
| 5,016,501 | A | 5/1991 | Holzer, Jr. |
| 5,044,643 | A | 9/1991 | Nakamura |
| 5,172,923 | A | 12/1992 | Nakamura |
| 5,183,274 | A | 2/1993 | Sakamaki |
| 5,236,206 | A | 8/1993 | Rohm |
| 5,261,679 | A | 11/1993 | Nakamura |
| 5,271,471 | A | 12/1993 | Sasaki |
| 5,272,845 | A | 12/1993 | Burkley |
| 5,277,527 | A | 1/1994 | Yokota et al. |
| 5,322,303 | A | 6/1994 | Nakamura |
| 5,325,931 | A | 7/1994 | Woods |
| 5,375,857 | A | 12/1994 | Rohm |
| 5,375,858 | A | 12/1994 | Röhm |
| 5,407,215 | A | 4/1995 | Yang |
| 5,430,944 | A | 7/1995 | Shilling |
| 5,458,345 | A | 10/1995 | Amyot |
| 5,464,230 | A | 11/1995 | Röhm |
| 5,533,581 | A | 7/1996 | Barth et al. |
| 5,558,478 | A | 9/1996 | Odendahl et al. |
| 5,577,872 | A | 11/1996 | Nakamura |
| 5,624,013 | A | 4/1997 | Tsai |
| 5,653,294 | A | 8/1997 | Thurler |
| 5,704,257 | A | 1/1998 | Kottke et al. |
| 5,732,805 | A | 3/1998 | Nakamura |
| 5,947,254 | A | 9/1999 | Jones |
| 5,984,022 | A | 11/1999 | Harman, Jr. et al. |
| 6,010,426 | A | 1/2000 | Nakamura |
| 6,176,801 | B1 | 1/2001 | Chen |
| 6,273,200 | B1 | 8/2001 | Smith et al. |
| 6,277,013 | B1 | 8/2001 | Sasaki et al. |
| 6,279,714 | B1 | 8/2001 | Hsu |
| 6,305,481 | B1 | 10/2001 | Yamazaki et al. |
| 6,311,787 | B1 | 11/2001 | Berry et al. |
| 6,497,316 | B1 | 12/2002 | Hsu |
| 6,702,090 | B1 * | 3/2004 | Nakamura et al. ..... 192/223.2 |

FOREIGN PATENT DOCUMENTS

| | | |
|---|---|---|
| EP | 0 031 433 | 7/1981 |
| EP | 0 416 612 | 3/1991 |
| EP | 0 600 854 | 6/1994 |
| GB | 2 115 337 | 9/1983 |
| GB | 2 236 968 | 4/1991 |
| GB | 2 285 003 | 6/1995 |
| JP | 58217276 | 12/1983 |
| JP | 6190881 | 5/1986 |
| JP | 62182725 | 11/1987 |
| JP | 6363353 | 12/1988 |
| JP | 125667 | 5/1989 |
| JP | 459110 | 9/1992 |
| JP | 513789 | 2/1993 |
| JP | 7-219726 | 8/1995 |
| WO | WO 95/00288 | 1/1995 |
| WO | WO 95/01240 | 1/1995 |
| WO | WO 96/19677 | 6/1996 |
| WO | WO 97/27020 | 7/1997 |
| WO | WO 01/78948 | 10/2001 |

OTHER PUBLICATIONS

Service Parts List for Milwaukee Electric Tool Corporation 3/8 Inch Drill with Spindle Lock, dated Jan. 2001 (Statement of Relevance attached).

Drawing of Spindle Lock Assembly, Part No. 14-29-0040, from Milwaukee Electric Tool Corporation 3/8 Inch Drill with Spindle Lock, date unknown.

Drawing of Click Spring, Part No. 40-50-8525, from Milwaukee Electric Tool Corporation 3/8 Inch Drill with Spindle Lock, date unknown.

Drawing of Spindle Gear, Part No. 32-75-0106, from Milwaukee Electric Tool Corporation 3/8 Inch Drill with Spindle Lock, date unknown.

Milwaukee Electric Tool Cordless 2.4 Volt Screwdriver, date unknown.

* cited by examiner

POWER TOOL AND SPINDLE LOCK SYSTEM

RELATED APPLICATIONS

The present application is a continuation-in-part of prior-filed, U.S. patent application Ser. No. 10/096,441, filed Mar. 12, 2002 now U.S. Pat. No. 6,702,090, which is a continuation-in-part of U.S. patent application Ser. No. 09/995,256, filed Nov. 27, 2001, now abandoned, and the subject matter of both applications is hereby incorporated by reference.

FIELD OF THE INVENTION

The invention relates to power tools and, more particularly, to a spindle lock system for a power tool.

BACKGROUND OF THE INVENTION

A typical electric machine, such as a rotary power tool, includes a housing, a motor supported by the housing and connectable to a power source to operate the motor, and a spindle rotatably supported by the housing and selectively driven by the motor. A tool holder, such as a chuck, is mounted on the forward end of the spindle, and a tool element, such as, for example, a drill bit, is mounted in the chuck for rotation with the chuck and with the spindle to operate on a workpiece.

To assist the operator in removing and/or supporting the tool element in the tool holder, the power tool may include a spindle lock for preventing rotation of the spindle relative to the housing when a force is applied by the operator to the tool holder to remove the tool element. Without the spindle lock, such a force would tend to rotate the spindle relative to the housing. The spindle lock may be a manually-operated spindle lock, in which the operator engages a lock member against the spindle to prevent rotation of the spindle, or an automatic spindle lock, which operates when a force is applied by the operator to the tool holder.

There are several different types of automatic spindle locks. One type of automatic spindle lock includes a plurality of wedge rollers which are forced into wedging engagement with corresponding wedge surfaces when a force is applied by the operator to the tool holder. Another type of automatic spindle lock includes inter-engaging toothed members, such as a fixed internally-toothed gear and a movable toothed member supported on the spindle for rotation with the spindle and for movement relative to the spindle to a locked position in which the teeth engage to prevent rotation of the spindle.

To accommodate such automatic spindle locks, some rotational play or movement may be provided between the spindle and the driving engagement with the motor. The spindle lock operates (is engaged and disengaged) within this "free angle" of rotation between the spindle and the driving engagement of the motor.

SUMMARY OF THE INVENTION

One independent problem with the above-identified automatic spindle locks is that, when the motor is switched from an operating condition, in which the spindle is rotatably driven, to a non-operating condition, the inertia of the still-rotating spindle (and tool holder and/or supported tool element) causes the automatic spindle lock to engage to stop the rotation of the spindle relative to the motor within the free angle of rotation between the spindle and the motor. The engagement of the spindle lock can be sudden, causing an impact in the components of the spindle lock, resulting in noise (a big "clunk") and, potentially, damage to the components.

This problem is increased the greater the inertia acting on the spindle (i.e., with larger tool elements, such as hole saws). With the high-inertia tool elements, the spindle may rebound from the impact (of the spindle lock engaging), rotate in the opposite direction (through the free angle of rotation) and impact the driving engagement with the motor, and rebound (in the forward direction) to re-engage the spindle lock. Such repeated impacts on the spindle lock and between the spindle and the driving engagement of the motor causes a "chattering" phenomenon (multiple noises) after the initial impact and big "clunk".

Another independent problem with existing power tools is that, when the motor is switched from the operating condition to the non-operating condition, a braking force may be applied to the motor while the spindle (under the force of the inertia of the spindle (and tool holder and/or supported tool element) continues to rotate through the free angle. The braking of the motor. (coupled with the continued rotation of the spindle) causes the automatic spindle lock to engage resulting in noise (a big "clunk" and/or "chattering") and, potentially, damage to the components.

The braking force applied to the motor can result from dynamic braking of the motor, such as by the operation of a dynamic braking circuit or as results in the operation (stopping) of a cordless (battery-powered) power tool. In other words, when the motor is stopped, the difference between the force rotating the spindle (the inertia of the spindle (and tool holder and/or supported tool element) and the force stopping the motor (i.e., whether the motor coasts or is braked) causes the automatic spindle lock to engage. The greater difference in these oppositely acting forces, the greater the impact(s) (a big "clunk" and/or "chattering") when the spindle lock engages.

The present invention provides a power tool and a spindle lock system which substantially alleviates one or more of the above-described and other problems with existing power tools and spindle locks. In some aspects, the invention provides a spindle lock including a spring element for delaying operation of the spindle lock and a detent arrangement defining a position corresponding to a run position of the power tool and a position corresponding to a locked position of the spindle lock. In one rotational direction (i.e., the forward direction), a projection is positioned in first recess to provide an unlocked position and in a second recess to provide the locked position. In the opposite rotational direction (i.e., the reverse direction), the projection is positioned in the second recess to provide the unlocked position and in the first recess to provide the locked position.

In some aspects, the invention provides a spindle lock including a spring element which applies substantially equal spring force to delay the operation of the spindle lock when the spindle is rotated in the forward direction or in the reverse direction. In some aspects, the invention provides two spring members which cooperate to apply the substantially equal force to delay the operation of the spindle lock when the spindle is rotated in the forward direction or in the reverse direction.

In some aspects, the spindle lock is a wedge roller type spindle lock. In some aspects, the invention provides a spindle lock including a synchronization member for synchronizing the engagement of the locking members and the locking surfaces of the spindle lock. In some aspects, the invention provides a spindle lock having an aligning member for aligning the axis of the wedge roller with the axis of the spindle and maintaining such an alignment. In some aspects, the invention provides a battery-powered tool including a spindle lock.

In some aspects, the invention provides a spindle lock including a first locking member defining a first locking surface, a second locking member defining a second locking surface and a wedge positioned between the first locking member and the second locking member and positionable in a locked position, in which the wedge is wedged between the first locking surface and the second locking surface to prevent rotation of the spindle, and in an unlocked position. In some aspects, the invention provides a spring operable to delay movement of the wedge from the unlocked position to the locked position and being flexible in a direction generally parallel to a spindle axis when a force is applied to the spindle to cause the spindle to rotate relative to the driving connection. In some aspects, the invention provides a spindle lock in which the wedge and at least one of the first and second locking members include inter-engaging teeth engageable to prevent rotation of the spindle when the wedge is in the locked position.

In some aspects, the invention provides a spindle lock including a first locking member defining a first locking surface and a drag surface, a second locking member defining a second locking surface, and a drag element positioned adjacent to the drag surface and being engageable with the drag surface to resist rotation of the second locking member with respect to the first locking member when a force is applied to the spindle to cause the spindle to rotate relative to the driving connection and when the force is removed from the spindle.

One independent advantage of the present invention is that stopping of the motor and automatic locking of the spindle can be done quietly without producing the impact or "clunk" accompanied by the sudden engagement of the spindle lock. The resilient force of the spring element of the spindle rotation controlling structure buffers and controls the rotation of the spindle caused by the inertia of the spindle (and tool holder and/or supported tool element). This resilient force also buffers and controls the inertia of the spindle when there is little or no relative rotation between the spindle and the driving engagement with the motor.

Another independent advantage of the present invention is that, even if the inertia of the spindle, tool holder and supported tool element is greater than the resilient force of the spring element of the spindle rotation controlling structure (such that the rotation of the spindle does not stop immediately upon the initial engagement of the spindle lock), the spring element buffers and controls the rotation of the spindle to dissipate the rotating energy of the spindle without the repeated impacts and rebounds or "chattering", providing a more quiet stopping of the spindle.

A further independent advantage of the present invention is that, even when the motor is braked at stopping, such as by the operation of a braking circuit or in the operation of a cordless power tool, the spindle lock and the spring element of the spindle rotation controlling structure will quietly stop the rotation of the spindle, tool holder and tool element.

Other independent features and independent advantages of the present invention will become apparent to those skilled in the art upon review of the following detailed description, claims and drawings.

Figure 1:
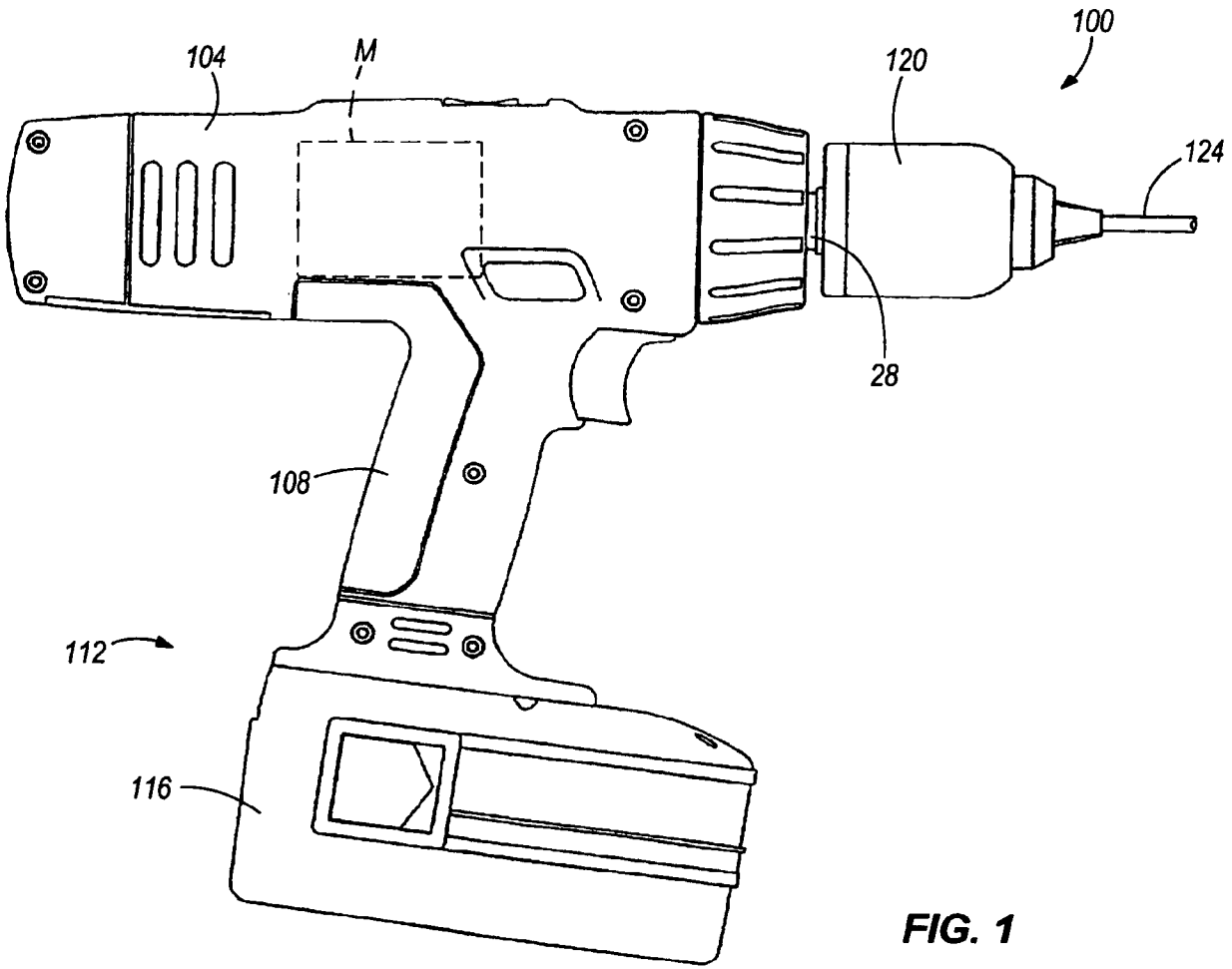
FIG. 1 is a side view of a cordless power tool including a spindle lock system embodying aspects of the invention.

Before at least one embodiment of the invention is explained in detail, it is to be understood that the invention is not limited in its application to the details of the construction and the arrangements of the components set forth in the following description or illustrated in the drawings. The invention is capable of other embodiments and of being practiced or carried out in various ways. Also, it is understood that the phraseology and terminology used herein is for the purpose of description and should not be regarded as limiting.

DETAILED DESCRIPTION

FIG. 1 illustrates a power tool 100 including (see FIG. 3) a spindle lock system 10 embodying the invention. As shown in FIG. 1, the power tool 100 includes a housing 104 having a handle 108 to be gripped by an operator during operation of the power tool 100. A motor M (schematically illustrated) is supported by the housing 104, and a power source 112, such as, in the illustrated construction, a battery 116, is connectable to the motor M by an electrical circuit (not shown) to selectively power the motor M.

The power tool 100 also includes a spindle 28 rotatably supported by the housing 104 and selectively driven by the motor M. A tool holder or chuck 120 is supported on the forward end of the spindle 28 for rotation with the spindle 28. A tool element, such as, for example, a drill bit 124, is supported by the chuck 120 for rotation with the chuck 120.

In the illustrated construction, the power tool 100 is a drill. It should be understood that, in other constructions (not shown), the power tool 100 may be another type of power tool, such as, for example, a screwdriver, a grinder or a router. It should also be understood that, in other constructions (not shown), the tool element may be another type of tool element, such as, for example, a screwdriver bit, a grinding wheel, a router bit or a hole saw.

Figure 2:
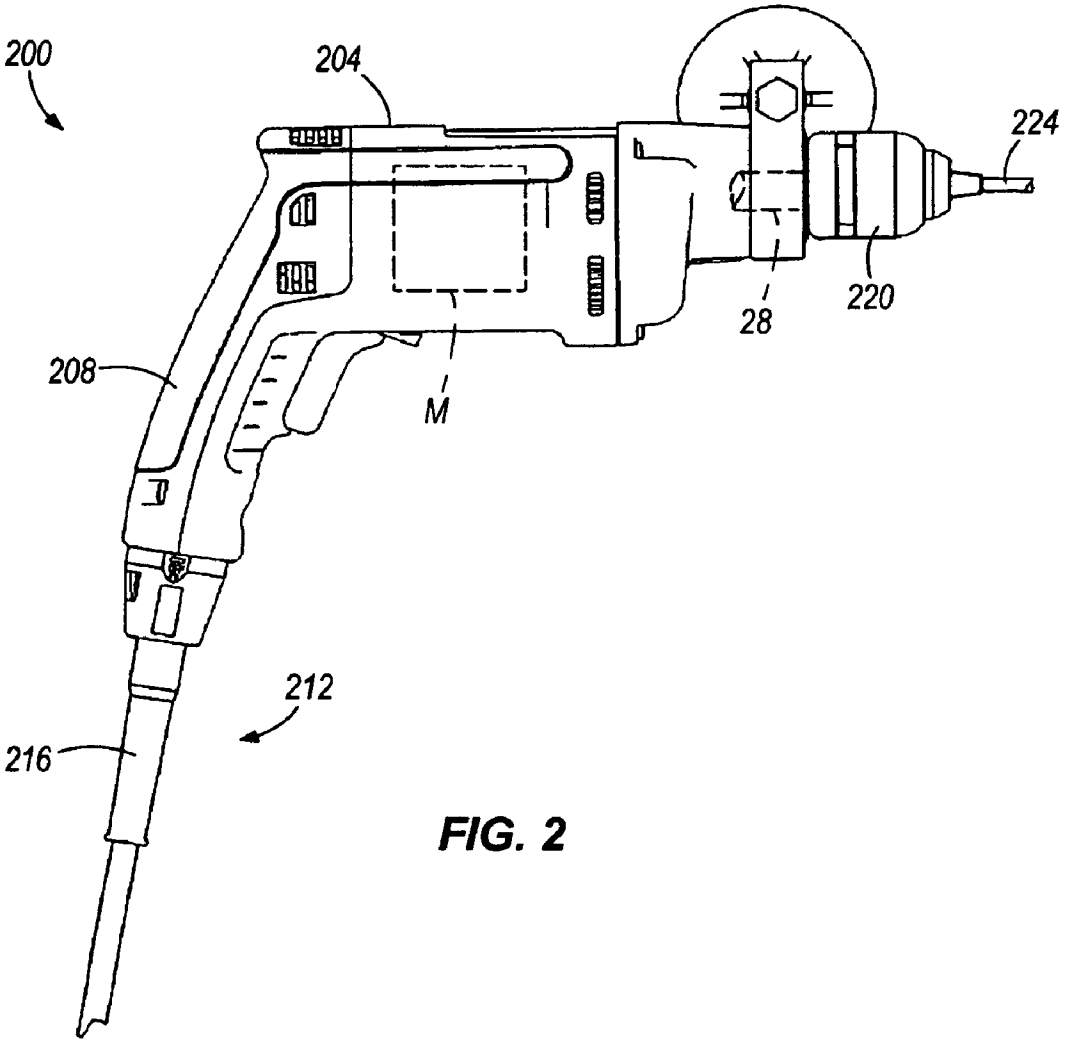
FIG. 2 is a side view of a corded power tool including a spindle lock system embodying aspects of the invention.

FIG. 2 illustrates another power tool 200 for use with the spindle lock 10. As shown in FIG. 2, the power tool 200 is a corded power tool including a housing 204 providing a handle 208 and supporting a motor M' (schematically illustrated) which is connectable to an AC power source 212 by a plug 216 to selectively power the motor M'.

Figure 2A:
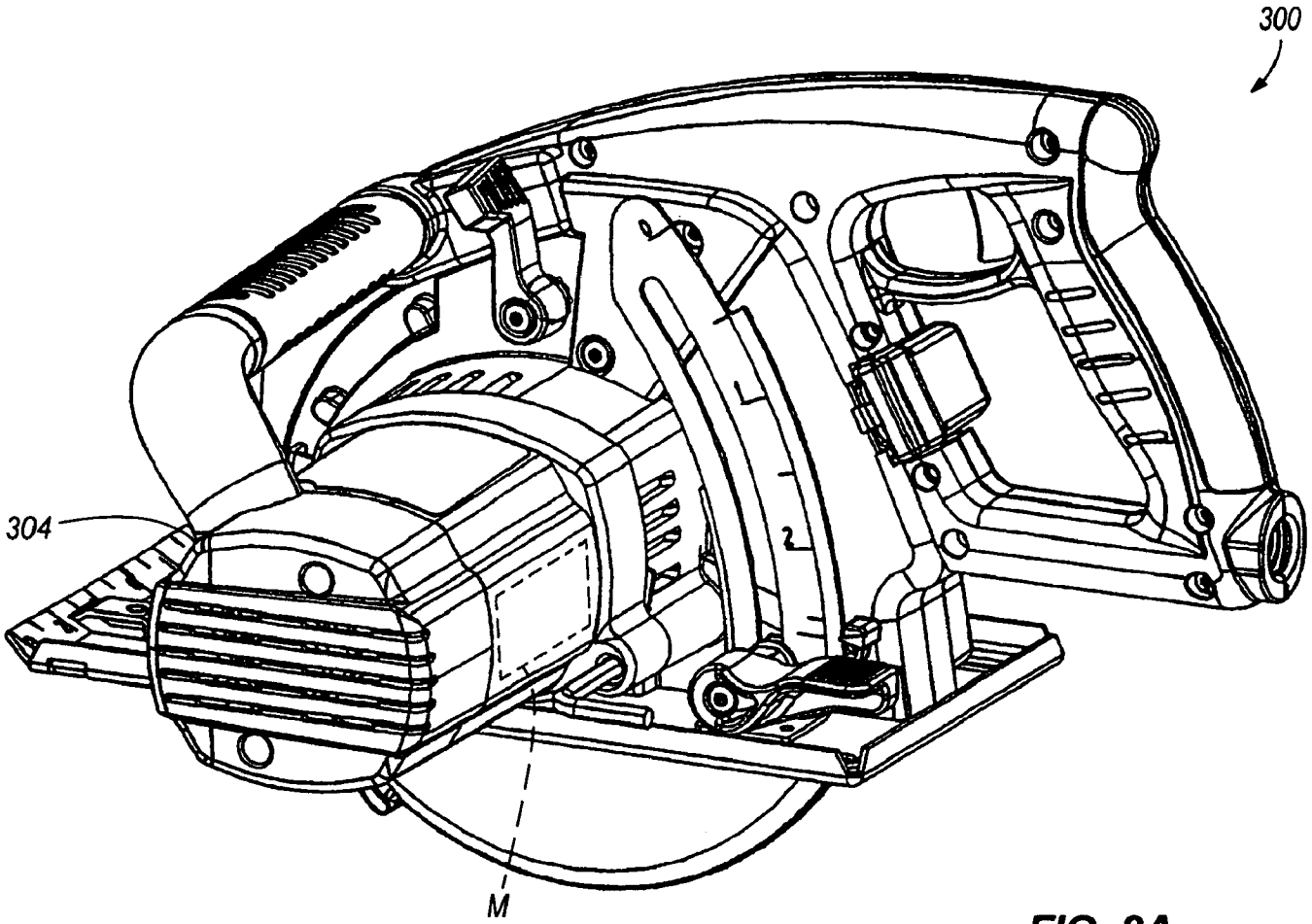
FIG. 2A is a side view of another corded power tool including a spindle lock system embodying aspects of the invention.

FIG. 2A illustrates still another power tool 300 for use with the spindle lock 10. As shown in FIG. 2A, the power tool is a corded circular saw including a housing 304 providing a handle and a supporting a motor M" (schematically illustrated) which is connectable to an AC power source by a plug (not shown) to selectively power the motor M". The power tool 300 includes a tool holder (not shown) supported on the forward end of the spindle (not shown) for rotation with the spindle. A tool element, such as, for example, a saw blade (not shown), is supported by the tool holder for rotation with the tool holder.

Figure 3:
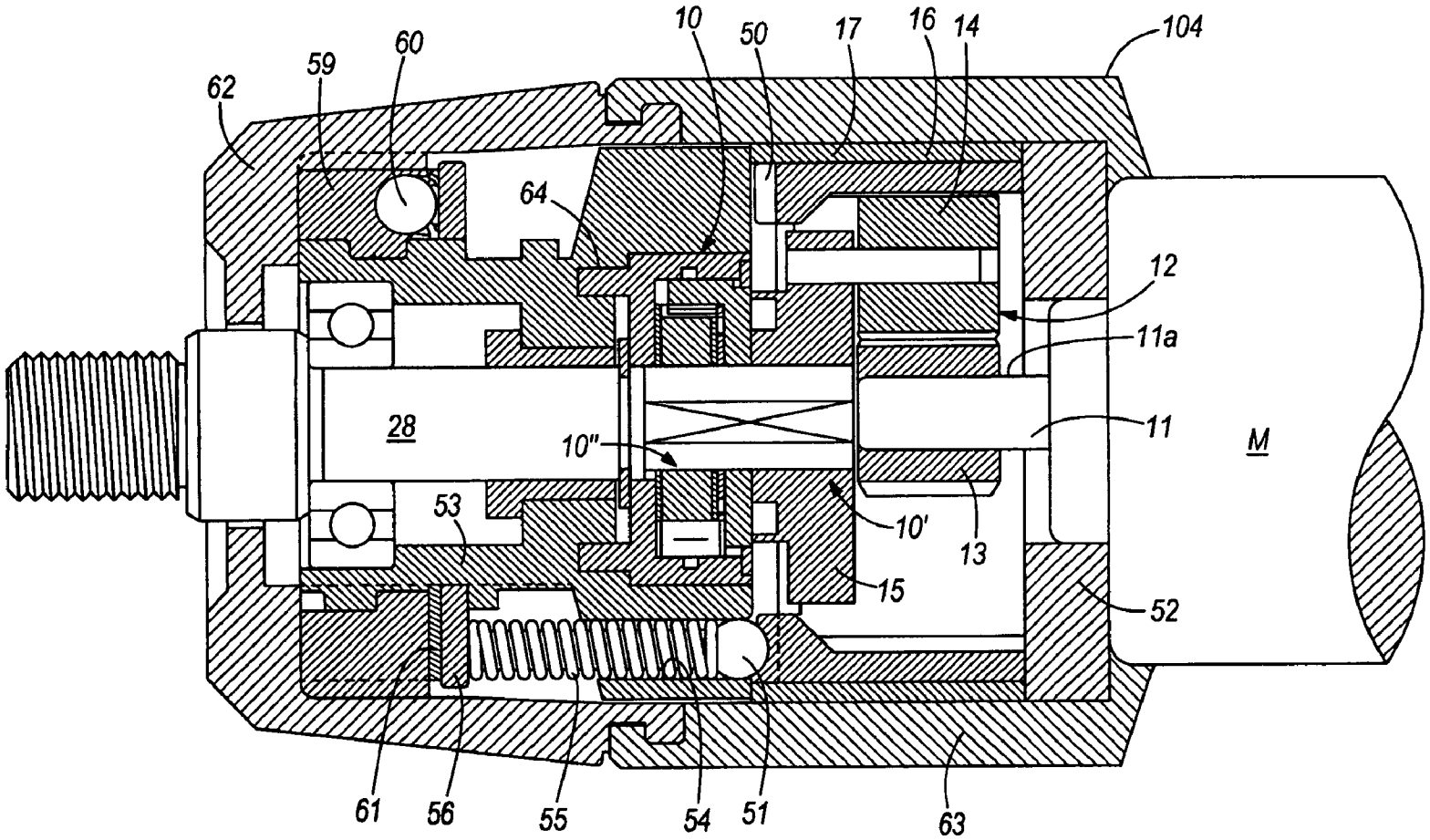
FIG. 3 is a partial cross-sectional side view of a portion of the power tool shown in FIG. 1 and illustrating the spindle lock system embodying aspects of the present invention.

As shown in FIG. 3, the motor M includes an output shaft 11*a* defining a motor axis 11 and rotatably supported by the housing 104. In the illustrated construction, the motor M is connected to a speed reduction structure 12 of a planetary gear. The speed reduction structure 12 includes a sun gear 13 connected by an attaching structure, such as splines, to the output shaft 11*a* for rotation with the output shaft 11*a*. The speed reduction structure 12 also includes a planetary gear 14 supported by a carrier 15 and engageable between the sun gear 13 and an internal gear 16. The internal gear 16 is supported by a fixing ring 17 which is supported by the housing 104. Rotation of the motor shaft 11*a* and the sun gear 13 causes rotation of the planet gear 14, and engagement of the rotating planet gear 14 with the internal gear 16 causes the planet gear 14 to revolve around the sun gear 13 and rotation of the carrier 15.

The spindle lock system 10 is supported on the outputting side of the motor M (on the outputting side of the speed reduction structure 12). The spindle lock system 10 includes a driving engagement or an output electric structure 10' for conveying the output force of the motor M, through the carrier 15 of the speed reduction structure 12, to the spindle 28. The spindle lock system 10 also includes locking structure 10" for locking the spindle 28 and selectively preventing rotation of the spindle 28 relative to the housing 104 and relative to the carrier 15 and motor M.

Figure 4:
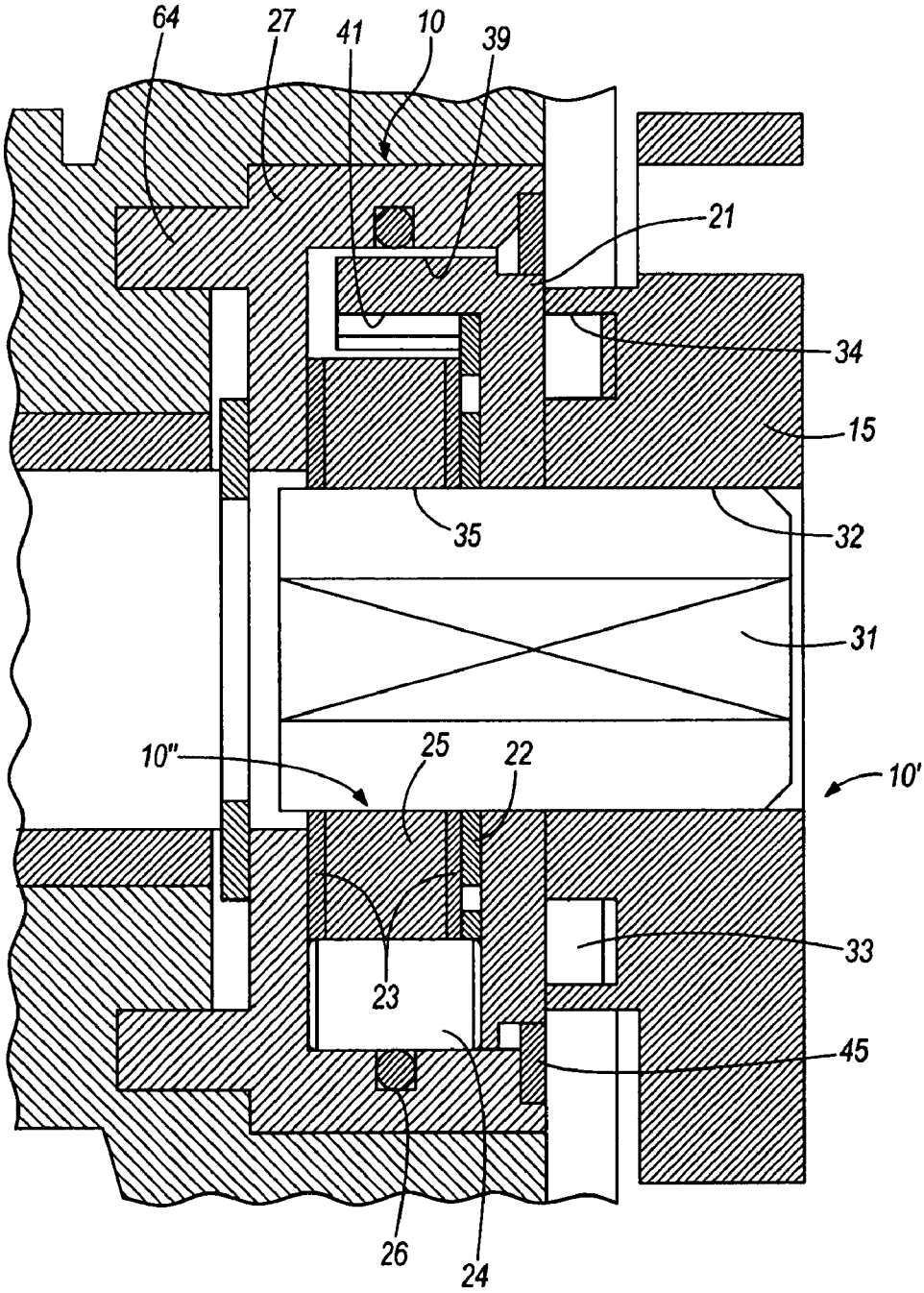
FIG. 4 is an enlarged cross-sectional side view of a portion of the spindle lock system shown in FIG. 3.
Figure 8:
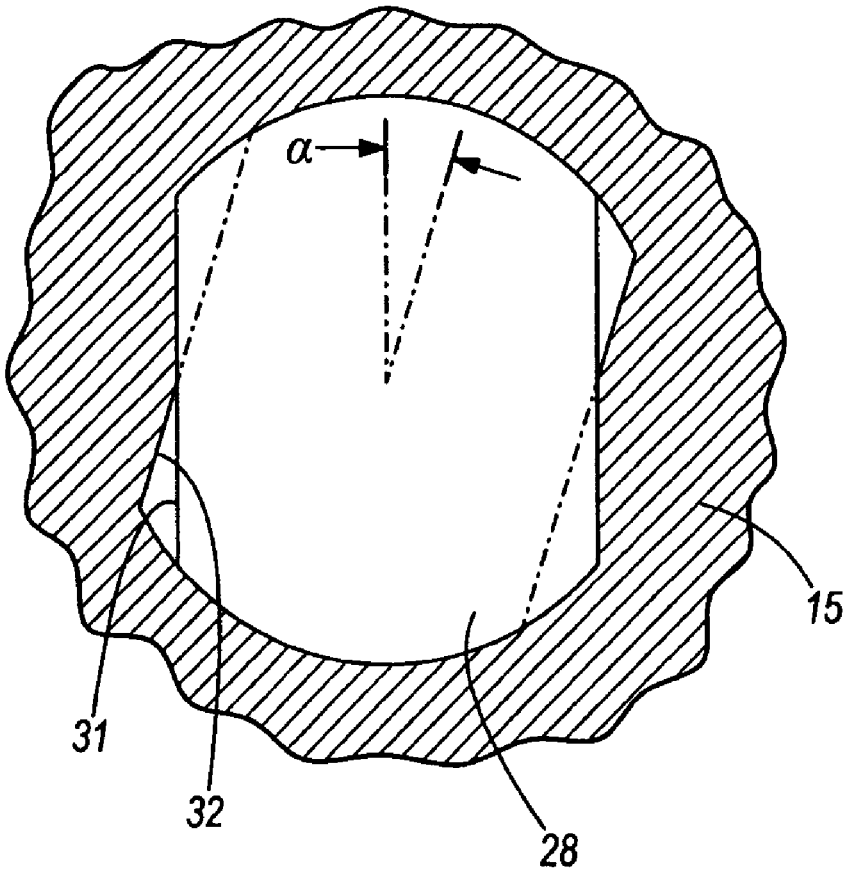
FIG. 8 is a partial cross-sectional view illustrating the connection of the spindle with the carrier.

As shown in more detail in FIGS. 4 and 8, the driving engagement 10' between the spindle 28 and the carrier 15 and motor M includes a connector 31 formed on the end of the spindle 28 (as two generally parallel planar surfaces on opposite sides of the spindle axis) and a hole-shaped connector 32 formed on the carrier 15. The connector 32 has sidewalls which are formed to provide a free angle α (of about 20 degrees in the illustrated construction) in which the spindle 28 and the carrier 15 are rotatable relative to one another to provide some rotational play between the spindle 28 and the carrier 15. When the connecting parts 31 and 32 are connected, there is a free rotational space in which the carrier 15 will not convey rotating force to the spindle 28 but in which the carrier 15 and the spindle 28 are rotatable relative to one another for the free angle α. In the illustrated construction, the shape of the connector 32 provides this free play in both rotational directions of the motor M and spindle 28.

Figure 5:
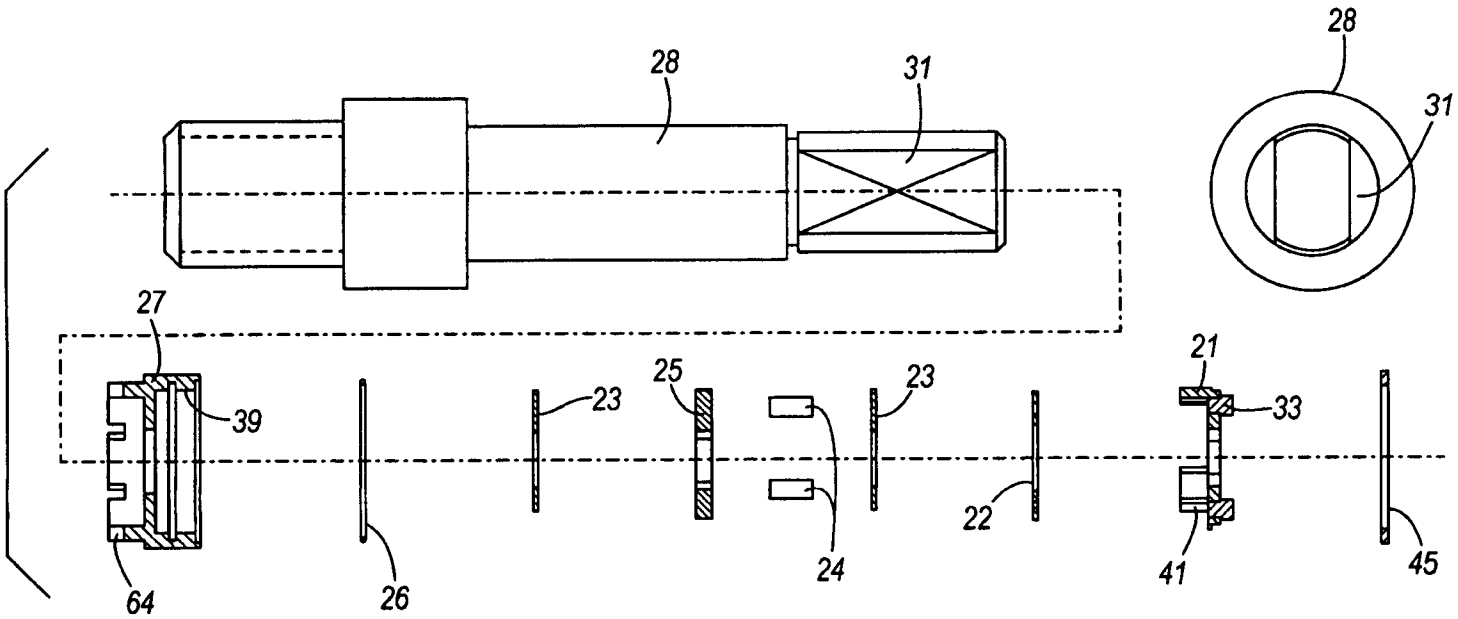
FIG. 5 is an exploded view of the components of the spindle lock system shown in FIG. 4.
Figure 6:
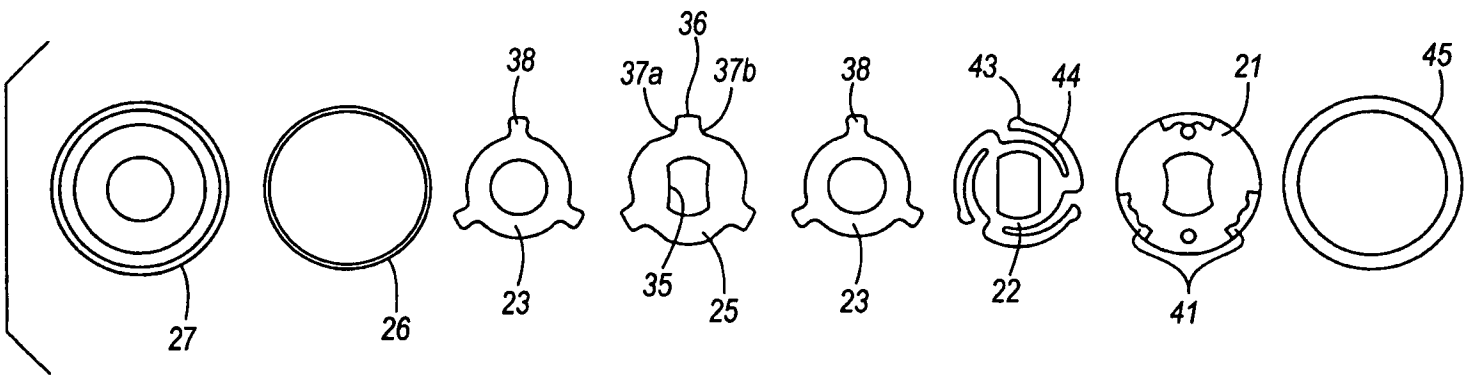
FIG. 6 is a view of the components of the spindle lock system shown in FIG. 5.

As shown in FIGS. 4–6, the locking structure 10" generally includes a release ring 21, a spring or snap ring 22, two synchronizing and aligning or supporting rings 23, one or more locking members or wedge rollers 24, a lock ring 25, a rubber ring 26, a fixing ring 27 and the spindle 28. Except for the wedge rollers 24 and the spindle 28, the other components of the locking structure 10" are generally in the shape of a ring extending about the same axis, such as the axis of the spindle 28. A lid ring 45 is attached to the fixing ring 27 such that the components of the locking structure 10" are provided as a unit.

As shown in FIGS. 4–5, the release ring 21 includes pins 33 on opposite sides of the axis which are engaged and retained in connecting holes 34 formed on the carrier 15 so that the release ring 21 is fixed to and rotatable with the carrier 15. As shown in FIG. 6, the release ring 21 defines a hole-shaped connector **32*a* which is substantially identical to the connector 32 formed in the carrier 15 to provide the free rotational angle α between the spindle 28 and the carrier 15 and release ring 21**.

The lock ring 25 defines a hole-shaped connecting part 35 which is substantially identical to the connector 31 on the spindle 28 so that the lock ring 25 is fixed to and rotatable with the spindle 28 without free rotational movement. On the outer circumference, the lock ring 25 includes dividing protrusions 36 which, in the illustrated construction, are equally spaced from each other by about 120 degrees. On each circumferential side of each protrusion 36, inclined locking wedge surfaces **37*a* and 37*b* are defined to provide locking surfaces so that the spindle lock system 10 will lock the spindle 28 in the forward and reverse rotational directions. The wedge surfaces 37*a* and 37*b* are inclined toward the associated protrusion 36**.

In the illustrated construction, the locking members are wedge rollers 24 formed in the shape of a cylinder. A wedge roller 24 is provided for each locking wedge surface **37*a* and 37*b* of the lock ring 25. The wedge rollers 24 are provided in three pairs, one for each protrusion 36. One wedge roller 24 in each pair provides a locking member in the forward rotational direction of the spindle 28, and the other wedge roller 24 in the pair provides a locking member in the reverse rotational direction of the spindle 28. In the illustrated construction, the length of each wedge roller 24 is greater than the width or thickness of the lock ring 25, and the opposite ends of each wedge roller are supported by respective supporting rings 23**.

On the outer circumference of each supporting ring 23, supporting protrusions 38 are formed. In the illustrated construction, the supporting protrusions 38 are equally separated by about 120 degrees, and on each side of each supporting protrusion 38, a wedge roller 24 is supported. As shown in FIG. 6, the central opening of each supporting ring 23 is generally circular so that the supporting rings 23 are rotatable relative to the spindle 28.

The rubber ring 26 is supported in a groove in the fixing ring 27, and engagement of the wedge rollers 24 with the rubber ring 26 causes rotation of the wedge rollers 24 due to the friction between the wedge rollers 24 and the rubber ring 26. The fixing ring 27 defines an inner circumference or cavity 39 receiving the lock ring 25 and the supporting rings 23. The inner circumference 39 of the fixing ring 27 and the outer circumference of the lock ring 25 (and/or of the spindle 28) face each other in a radial direction and are spaced a given radial distance such that a pair of wedge rollers 24 are placed between a pair of inclined locking wedge surfaces **37*a* and 37*b* of the lock ring 25 and the inner circumference 39**.

The inclined locking wedge surfaces **37*a* and 37*b* and the inner circumference 39 of the fixing ring 27 cooperate to wedge the wedge rollers 24 in place in a locked position which corresponds to a locked condition of the spindle lock system 10, in which the spindle 28 is prevented from rotating relative to the housing 104 and relative to the motor M and carrier 15. Space is provided between the inner circumference 39 of the fixing ring 27 and the outer circumference of the lock ring 25 to allow the wedge rollers to move to a releasing or unlocked position which corresponds to an unlocked condition of the spindle lock system 10, in which the spindle 28 is free to rotate relative to the housing 104. In addition, the supporting protrusions 38 of the supporting rings 23 have a circumferential dimension allowing the wedge rollers 24** to be supported in the releasing or unlocked position.

The releasing ring 21 includes releasing protrusions 41 which are selectively engageable with the wedge rollers 24 to release or unlock the wedge rollers 24 from the locked position. The releasing protrusions 41 are formed on the forward side of the releasing ring 21 and, in the illustrated construction, are equally separated by about 120 degrees to correspond with the relative position of the three pairs of wedge rollers 24. Each releasing protrusion 41 is designed to release or unlock the associated wedge rollers 24 by engagement with the circumferential end part to force the wedge roller 24 in the direction of rotation of the releasing ring 21 (and the carrier 15 and motor M). The circumferential length of each releasing protrusion 41 is defined so that the releasing or unlocking function is accomplished within the free rotational angle α between the spindle 28 and the releasing ring 21 and the carrier 15. Preferably, the releasing or unlocking function is accomplished near the end of the free rotational angle α.

Each releasing protrusion 41 defines one portion of a detent arrangement or controlling structure for controlling the resilient force of the snap ring 22 between a detent position corresponding to an unlocked condition of the spindle lock system 10 and a detent position corresponding to the locked condition of the spindle lock system 10. In the illustrated construction, controlling concave recesses **42*a* and 42*b* are defined on the radially inward face of each releasing protrusion 41**.

Figure 7:
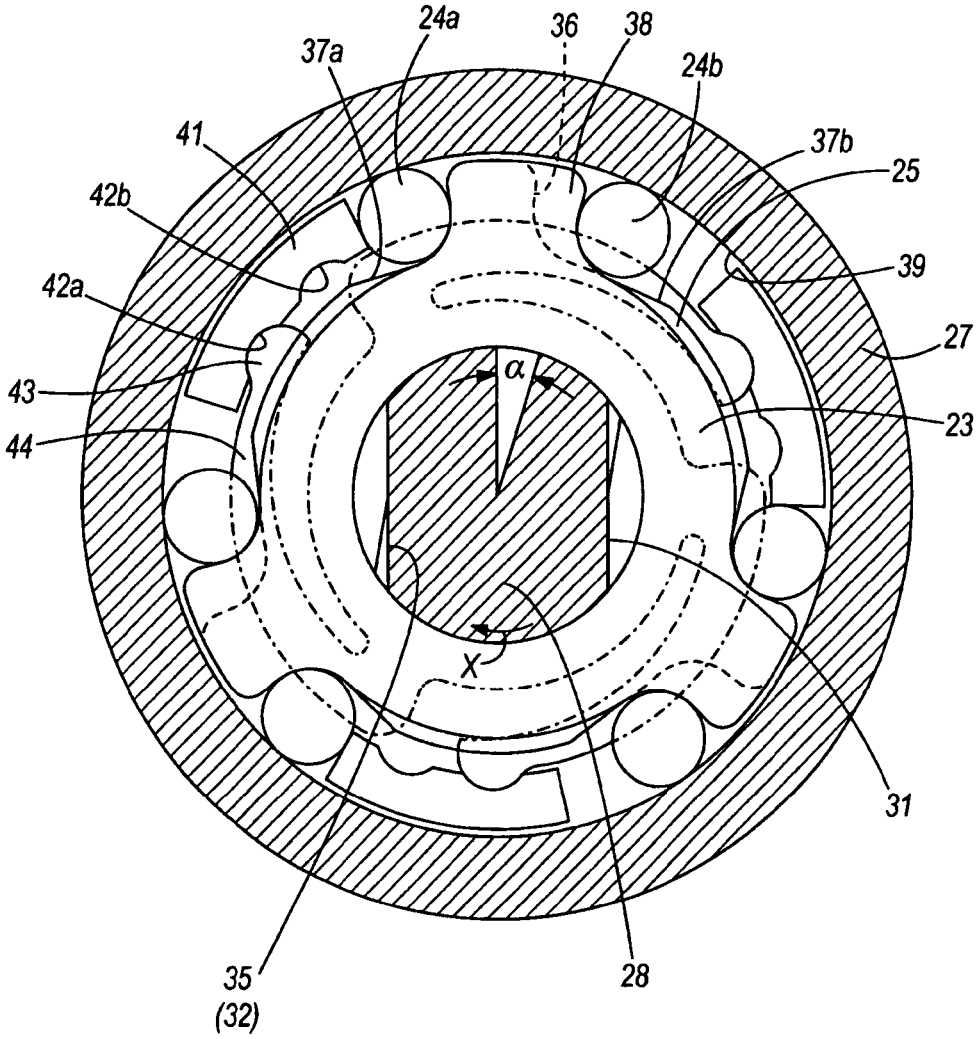
FIG. 7 is a partial cross-sectional view of components of the spindle lock system.

As shown in FIGS. 6–7, the snap ring 22 includes spring or snap arms 44 each having a controlling convex projection 43 formed at its free end. The projections 43 provide the other portion of the detent arrangement and are selectively engageable in one of a pair of corresponding recesses 42*a* and 42*b*. The snap ring 22 provides a resilient force to bias the projections into engagement with a selected one of the recesses 42*a* and 42*b*. The snap arms 44 are formed as arcuate arms extending generally in the same direction about the circumference from three equally separated positions on the body of the snap ring 22. The snap arms 44 are formed so that the projections 43 are selectively positionable in the associated recesses 42*a* and 42*b*. The resilient spring force on the projections 43 is provided by the elasticity and material characteristics of the snap arms 44.

The resilient force of the snap ring 22 is smaller than the drive force of the motor M and will allow the projections to move from one recess (i.e., recess 42*b*) to the other recess (i.e., recess 42*a*), when the motor M is restarted. As shown in FIG. 6, the central opening of the snap ring 22 is substantially identical to the connector 31 of the spindle 28 so that the snap ring 22 is fixed to and rotates with the spindle 28. The resilient force the snap arms 44 apply to the projections 43 is set to allow the projection 43 to move from one recess (i.e., recess 42*a*) to the other recess (i.e., recess 42*b*) to control and buffer the rotational force of the spindle 28 when the motor M is stopped and to delay the engagement of the locking structure 10".

Figure 9:
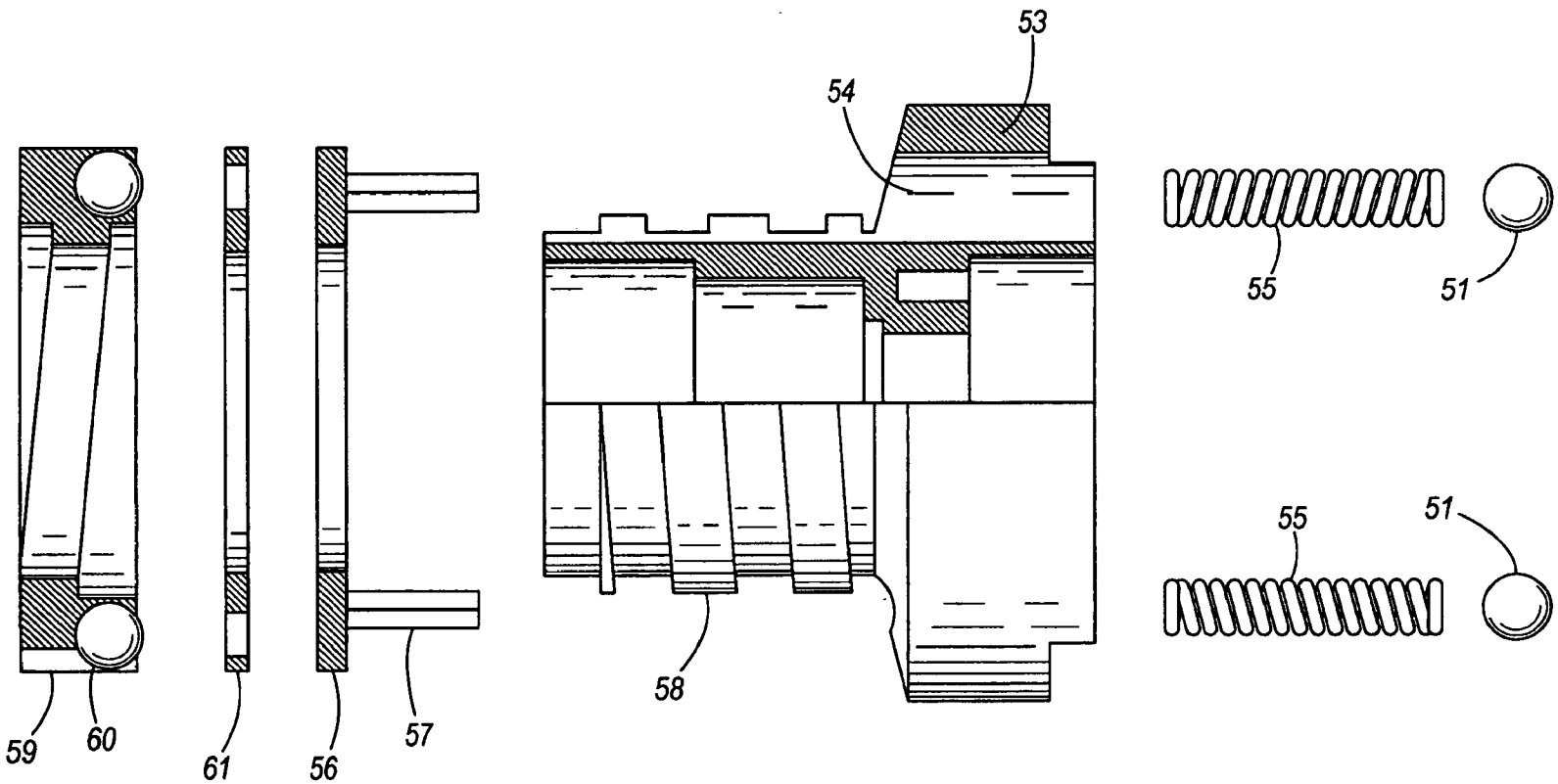
FIG. 9 is an exploded partial cross-sectional side view of a torque limiter.

As shown in FIGS. 3 and 9, the speed reduction structure 12 is provided with a torque limiter. The internal gear 16 is supported to allow rotation relative to the fixing ring 17. The forward end of the internal gear 16 provides an annular surface 50. Balls 51 are pressed against the surface 50, and the internal gear 16 is pressed against a fixing plate 52 to prevent the internal gear 16 from rotating.

A plurality of balls 51 (six in the illustrated construction) are positioned about the circumference of the internal gear 16 in engagement with the surface 50. A fixing element 53 defines a hole 54 for each ball 51 and received the ball 51 and a biasing spring 55. The spring 55 presses the ball 51 against the surface 50 of the internal gear 16 so that the internal gear 16 is pressed against the fixing plate 52. A receiving element includes supporting pins 57 which support the respective springs 55.

The forward end of the fixing element 53 is formed with a screw 58. A nut 59 engages the screw thread 58 and axially moves, through the ball 60 and ring 61, the receiving element towards and away from the internal gear 16 to adjust the spring force applied by the springs 55 to the balls 51 and to the surface 50 of the internal gear 16. The nut 59 is connected to an operating cover 62 by a spline attachment, and rotation of the operating cover 62 causes rotation and axial movement of the nut 59.

The fixing ring 27 is fixed to the fixing element 53 through a retaining part 64 to prevent rotation of the fixing ring 27. Alternatively, the retaining part 64 may be formed in the shape of a pin to be inserted into a hole in the fixing element 53. The fixing plate 52, the fixing ring 17 and the fixing element 53 are fixed to the outer case 63 of the housing 104.

In operation, when the carrier 15 and the releasing ring 21 are rotated in the direction of arrow X (in FIG. 7) by operation of the motor M, the corresponding wedge roller 24*a* is pushed into a releasing or unlocked position of the inclined surface 37*a* of the lock ring 25 by the end of the releasing protrusion 41. The other wedge roller 24*b* is kept in contact with the inner circumference 39 of the fixing ring 27, and, by its frictional contact, the wedge roller 24*b* is pushed into the releasing position of the inclined surface 37*b*. This releasing or unlocking function is accomplished within the free rotational angle α between the spindle 28 and the carrier 15 and the motor M.

After the locking structure 10" is released or unlocked, the connecting part 32 of the carrier 15 and the connecting part 31 of the spindle 28 move into driving engagement so that the driving force of the carrier 15 (and motor M) is transferred to the spindle 28 and the spindle 28 rotates with the carrier 15. At this time, each projection 43 of each snap arm 44 is positioned in one recess (i.e., recess 42*a*, the "run" position recess) of each releasing protrusion 41, and the position of the releasing ring 21 and the lock ring 25 is controlled by the resilient force of the snap arms 44 in a releasing or unlocked position at one end of the free angle α.

During driving operation of the motor M, the releasing protrusion 41 provides a force necessary to push the wedge roller 24*a* into the releasing or unlocked position and does not provide a large impact force on the wedge rollers 24*a*. When the motor M is stopped (switched from the operating condition to the non-operating condition) rotation of the carrier 15 is stopped. Rotation of the spindle 28 is controlled and buffered by the resilient force of the snap arms 44 retaining the projection 43 in the selected recess (i.e., recess 42*a*). During stopping, if the inertia of the spindle 28 (and the chuck 120 and/or the supported bit 124) is less than the resilient force of the snap arms 44, rotation of the spindle 28 is stopped with the projections 43 being retained in the selected recess (i.e., recess 42*a*, the run position). In such a case, the resilient force of the snap ring 22 buffers and controls the inertia of the spindle 28 even when there is little or no relative rotation between the spindle 28 and the carrier 15 and the motor M.

When the inertia of the spindle 28 (and the chuck 120 and/or the bit 124) is greater than the resilient force of the snap arms 44, the inertia overcomes the resilient force of the snap arms 44 and the friction between the projections 43 and the inclined ramp surface adjacent to the selected recess 42*a* so that the projections 43 move from the recess 42*a* and to the other recess 42*b* (the "lock" position recess). Movement of the projections 43 from recess 42*a* and to the recess 42*b* resists the rotational inertia of the spindle 28 and controls and buffers the rotational inertia of the spindle 28 so that the rotation of the spindle 28 will be dissipated before the locking structure 10" engages.

Therefore, the rotational inertia of the spindle 28 (and the chuck 120 and/or bit 124) is controlled and buffered by the engagement of the projections 43 in the respective recesses 42*a* and movement to the recesses 42*b* under the resilient spring force applied the respective snap arms 44. The snap ring 22 controls the rotational force of the spindle 28 and delays the engagement of the wedge rollers 24 and the locking wedge surfaces 37 so that there is no impact in the components of the spindle lock system 10, and no noise (no big "clunk") is created when the rotation of the spindle 28 has stopped. Also, because the rotational force of the spindle 28 is controlled, there is no impact of the spindle lock and rebound through the free rotational angle α so that the "chattering" phenomenon is also avoided. The rotational control device of the spindle lock system 10 includes the detent arrangement provided by the recesses 42*a* and 42*b* and the projections 43 and the resilient spring force provided by the snap arms 44 of the snap ring 22.

When the operator operates the chuck 120 (which tends to rotate the spindle 28 relative to the carrier 15 and motor M), rotation of the spindle 28 will be prevented because of the functioning of the locking structure 10". When the operator attempts to rotate the spindle 28 (i.e., by operating the chuck 120), the wedge rollers 24 will be wedged between the inner circumference 39 of the fixing ring 27 and the respective inclined locking wedge surfaces 37*a* and 37*b* of the lock ring 25 so that rotation of the spindle 28 in each rotational direction will be prevented. Because the spindle 28 is prevented from rotating, the chuck 120 can be easily operated to remove and/or support the bit 124.

When the motor M is restarted (switched from the non-operating condition to the operating condition, the end of the releasing protrusion 41 (in the selected rotational direction) moves one wedge roller 24*a* to a releasing position. The other wedge roller 24*b* engages the inner circumference 39 of the fixing ring 27 and is pushed into a releasing position. Once the wedge rollers 24 are released, the spindle 28 is free to rotate. The spindle 28 begins to rotate under the force of the motor M at the end of the free angle $\alpha$ of rotation between the spindle 28 and the carrier 15 and motor M.

When the spindle 28 is driven and the wedge rollers 24 rotate about their respective axes and revolve about the spindle 28, the wedge rollers 24 are kept in contact with the rubber ring 26, and this contact resistance causes the wedge rollers 24 to rotate while revolving. This rotation of the wedge rollers 24 and engagement with the supporting protrusions 38 of the supporting rings 23 on a trailing portion of the respective wedge rollers 24 maintains the respective axes of the wedge rollers 24 in an orientation in which the roller axes are substantially parallel to the axis of the spindle 28.

Engagement of the supporting protrusions 38 of the supporting rings 23 with the trailing portion of the respective wedge rollers 24 during movement of the wedge rollers 24 from the unlocked position toward the locked position prevents the wedge rollers 24 from becoming misaligned. Preferably, the supporting protrusions 38 engage the trailing portion of the respective wedge rollers 24 from the unlocked position, to the locked position and in the locked position.

The supporting rings 23 thus provide an aligning feature for the wedge rollers 24. Because the roller axes are aligned with the axis of the spindle 28, when the wedge rollers are wedged between the inner circumference 39 of the fixing ring and the inclined wedge surfaces 37 of the lock ring 25, a line contact is provided between the wedge rollers 24 and these locking surfaces to provide maximum locking force. The supporting rings 23 also provide a synchronizing feature of the wedge rollers 24 so that the wedge rollers 24 simultaneously move to the locking position upon engagement of the locking structure 10".

Figure 10:
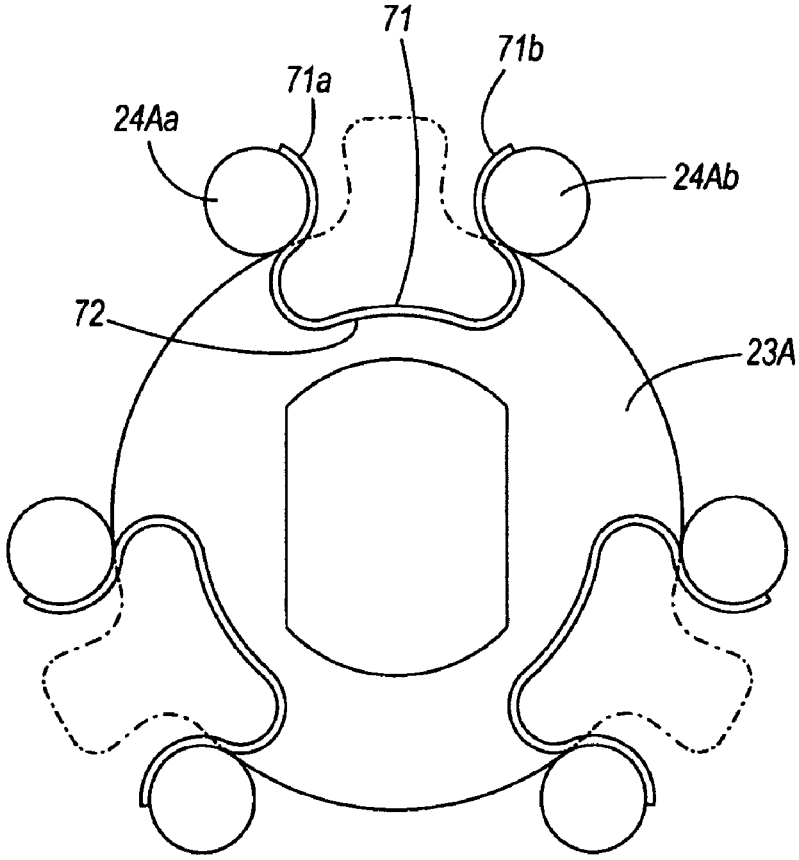
FIG. 10 is a view of a first alternative construction of the supporting ring.

FIG. 10 illustrates a first alternative construction for a supporting ring 23A. Common elements are identified by the same reference number "A".

In the earlier-described construction, the wedge rollers 24 are supported in the releasing position by the supporting protrusions 38 of the supporting ring 23. In the first alternative construction (shown in FIG. 10), the wedge rollers 24A are supported by concave parts 71*a* and 71*b* of an elastic material 71. Preferably, the elastic material 71 is formed of a flexible elastic material such as a spring material. A concave base 72 connects the parts 71*a* and 71*b* and is connected to the supporting ring 23A.

In the position shown in FIG. 10, the wedge rollers 24A are supported in a releasing position in close proximity to the locked position of each wedge roller 24A. The elastic member 71 supports the wedge rollers 24A with flexibility so that the wedge rollers 24A may flex the concave parts 71*a* and 71*b* to move towards a further released position. When the releasing protrusion 41A engages the wedge rollers 24A to release or unlock the wedge rollers 24A, the flexible elastic member 71 attenuates any resulting shock.

During driving of the spindle 28A, the leading concave parts 71*a* or 71*b* (depending on the driving direction of the spindle 28A) are compressed so that the trailing portion of the respective leading wedge rollers 24A are engaged by the respective concave parts 71*a* or 71*b* and by the dividing protrusions 36A on the lock ring 25A. When the motor M is stopped, the concave parts 71*a* or 71*b* expand and cause an initial locking engagement with the respective wedge rollers 24A. The expanding concave parts 71*a* or 71*b* also maintain engagement with the trailing portion of the respective wedge rollers 24A as the wedge rollers 24A move from the unlocked position toward the locked position. Preferably, the concave parts 71*a* or 71*b* maintain engagement with the trailing portion of the respective wedge rollers 24A as the wedge rollers 24A move from the unlocked position, to the locked position and in the locked position. This engagement prevents the wedge rollers 24A from becoming misaligned.

In this construction, the center opening of the supporting ring 23A is formed with a connecting part which is substantially identical to the connecting part 31A of the spindle 28A so that the supporting ring 23A is fixed to and rotatable with the spindle 28A. However, in an alternative construction (not shown), the central opening of the supporting ring 23A may be circular.

Figure 11:
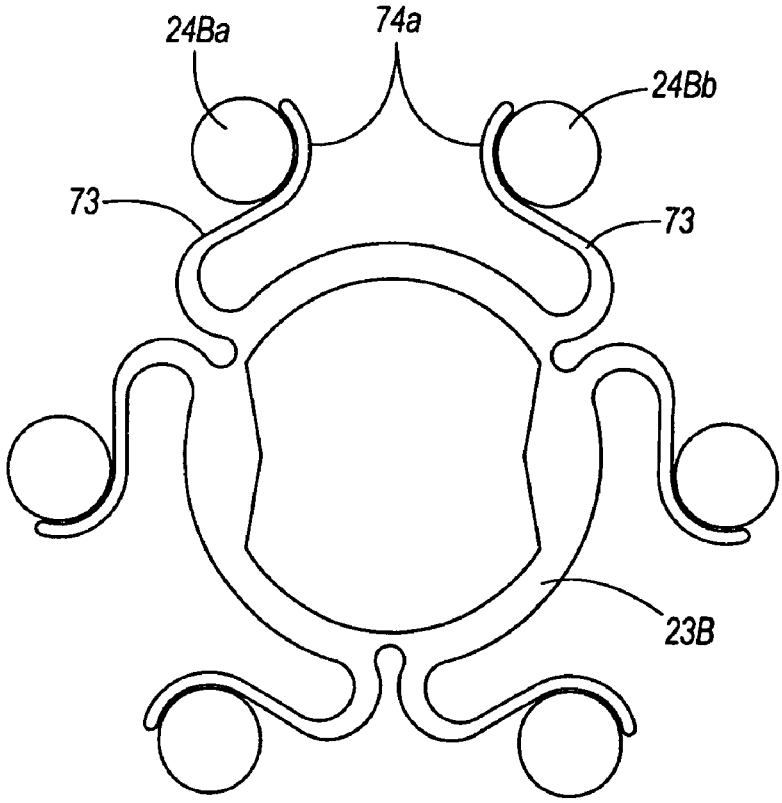
FIG. 11 is a view of a second alternative construction of the supporting ring.
Figure 12:
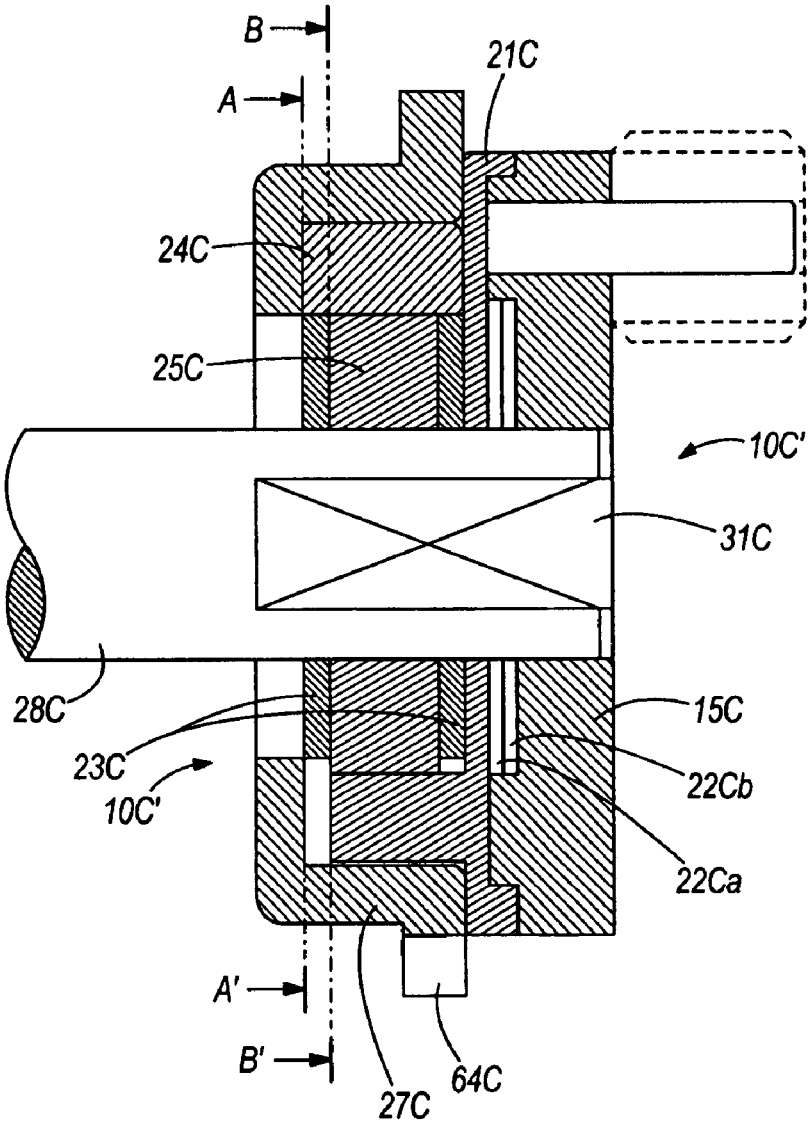
FIG. 12 is an enlarged partial cross-sectional side view of a first alternative construction of the rotation controlling structure of the spindle lock system taken generally along line C–C' in FIG. 14.

FIG. 11 illustrates a second alternative construction of a supporting ring 23B. Common elements are identified by the same reference number "B".

In the first alternative construction shown in FIG. 10, elastic material 71 was connected to the body of the supporting ring 23A. In the construction illustrated in FIG. 11, the supporting ring 23B includes arms 73 providing concave part 74*a* and 74*b* at their ends to provide a flexible support for the wedge rollers 24B. With the construction illustrated in FIG. 11, the supporting ring 23B with the elastic arms 73 provides the same operation as concave parts 71*a* and 71*b* of the supporting ring 23A illustrated in FIG. 10.

In the illustrated construction, the central opening of the supporting ring 23B is substantially identical to the connecting part 32B of the carrier 15B. As with the other supporting rings 23 and 23A, the central opening may be circular or may have the shape of the connecting part 31 of the spindle 28. In any of these constructions, the supporting ring 23, 23A and 23B may be formed of a metal plate or a synthetic resin.

FIGS. 12–15 illustrate a first alternative construction of the rotation control device of a spindle lock 10C. Common elements are identified by the same reference number "C".

As shown in FIGS. 12–15, the rotation control device includes a snap ring 22C formed by two snap ring elements 22Ca and 22Cb. The snap ring elements 22Ca and 22Cb are substantially identical and are supported in a reversed orientation relative to one another to provide the snap ring 22C.

In this construction, the forward end of the carrier 15C defines the control concave recesses 42Ca and 42Cb for receiving the control convex projections 43Ca and 43Cb on each of the snap ring elements 22Ca and 22Cb to provide the controlling and buffering of the continued rotation of the spindle 28C. The forward end of the carrier 15C includes a containing recess 82 having an inner circumference 81 receiving the two snap ring elements 22Ca and 22Cb. The recesses 42Ca and 42Cb are formed at three circumferentially spaced locations which correspond to the position of the recesses 42*a* and 42*b* in the earlier-described construction.

The snap rings 22Ca and 22Cb are received in the containing recess 82 to form the snap ring 22C. Each snap ring element 22Ca and 22Cb has a snap ring body from which respective snap arms 44Ca and 44Cb extend. Corresponding projections 43Ca and 43Cb are formed at the end of each snap arm 44Ca and 44Cb, respectively. In the illustrated construction, the snap ring elements 22Ca and 22Cb are supported so that the arms from one snap ring element (i.e., arms 44Ca of snap ring 22Ca) extend in one circumferential direction and the arms of the other snap ring elements (i.e., arms 44Cb of snap ring 22Cb) extend in the opposite circumferential direction.

The snap ring elements 22Ca and 22Cb are supported so that the corresponding projections 43Ca and 43Cb are aligned and are positioned in the same recess 42Ca or 42Cb. In this manner, the snap ring 22C provides the same force on the projections 43C when a force is applied to the snap ring 22C in either rotational direction by the spindle 28C. Because of the configuration of the snap ring elements 22Ca and 22Cb, in one rotational direction, one projection and snap arm (i.e., projection 43Ca and snap arm 44Ca) will apply a spring force to retain the projection 43Ca in the selected recess, and this spring force will provide a first portion of the total spring force applied by the snap ring 22C. At the same time, the other projection and snap arm (i.e., projection 43Cb and snap arm 44Cb) will apply a spring force to maintain the projection 43Cb in the selected recess, and this spring force will provide a second portion of the total force applied by the snap ring 22C.

In the opposite rotational direction, the first snap ring element 22Ca will apply a first spring force which is a first portion of the total force applied by the snap ring 22C, and the second snap ring element 22Cb will apply a second spring force which is a second portion of the total force applied by the snap ring 22C to control and buffer the rotation of the spindle 28C in that rotational direction. Because of the configuration of the snap ring elements 22Ca and 22Cb, the snap ring elements 22Ca and 22Cb apply a different force in each of the rotational directions when controlling and buffering the rotation of the spindle 28C. However, in each rotational direction, the snap ring 22C applies substantially the same spring force to control and buffer the rotation of the spindle 28C.

It should be understood, that in the earlier-described construction (shown in FIGS. 2–7), the snap ring 22 could include two separate snap ring elements (similar to snap ring elements 22Ca and 22Cb).

Figure 13:
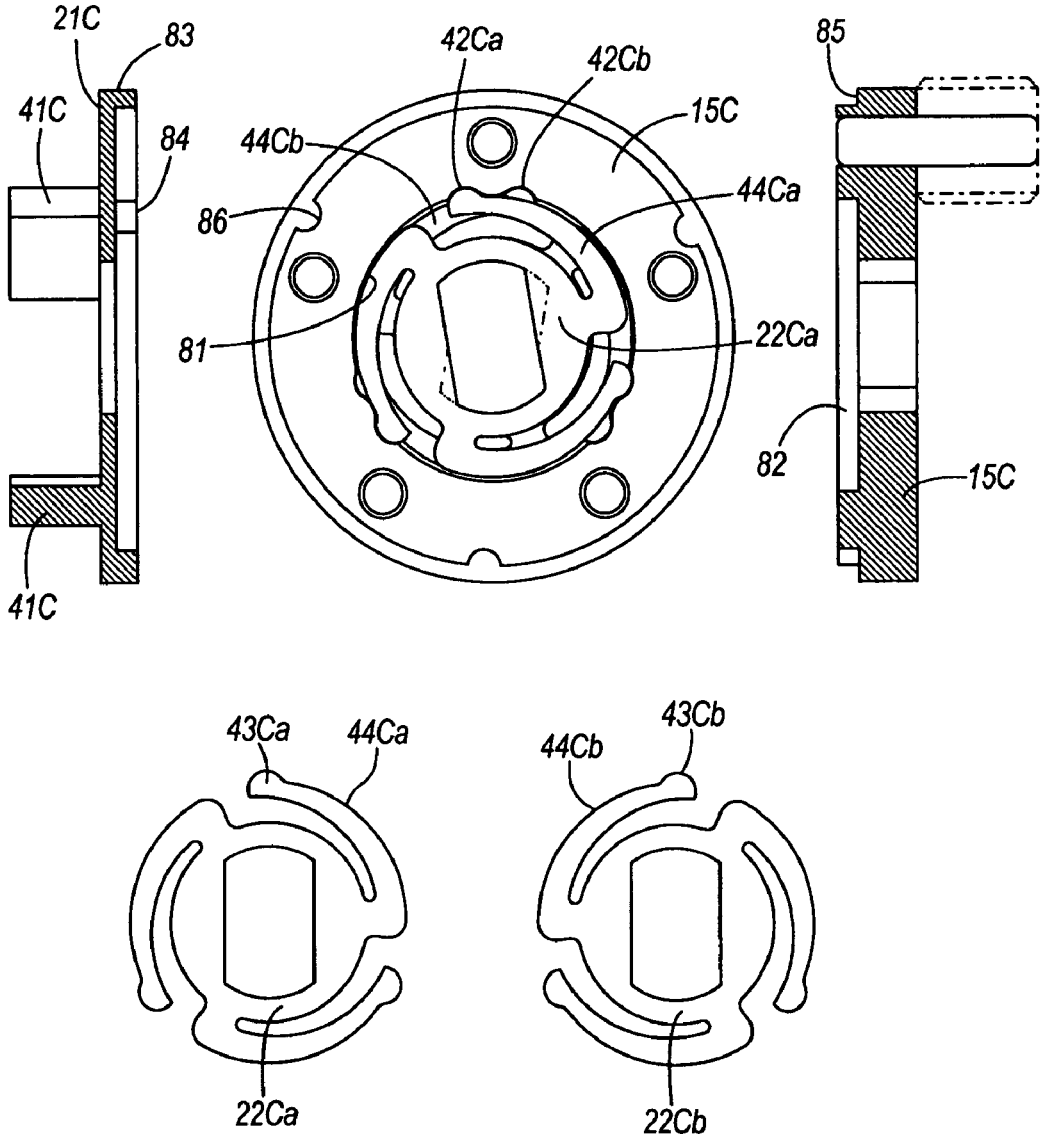
FIG. 13 is an exploded partial cross-sectional view of the rotation controlling structure shown in FIG. 12.

As shown in FIG. 13, a guard-like annular portion 83 is formed on the rear face of the releasing ring 21C, and retaining projections 84 are formed on the inner annular surface of the portion 83. A step 85 is formed on the outer circumference of the carrier 15C, and retaining recesses 86 are formed in locations about the step 85. The projections 84 and the recesses 86 engaged to fix the releasing ring 21C to the carrier 15C as a unit. The snap ring 22C and snap ring elements 22Ca and 22Cb are received in the space between the carrier 15C and the releasing ring 21C.

Figure 14:
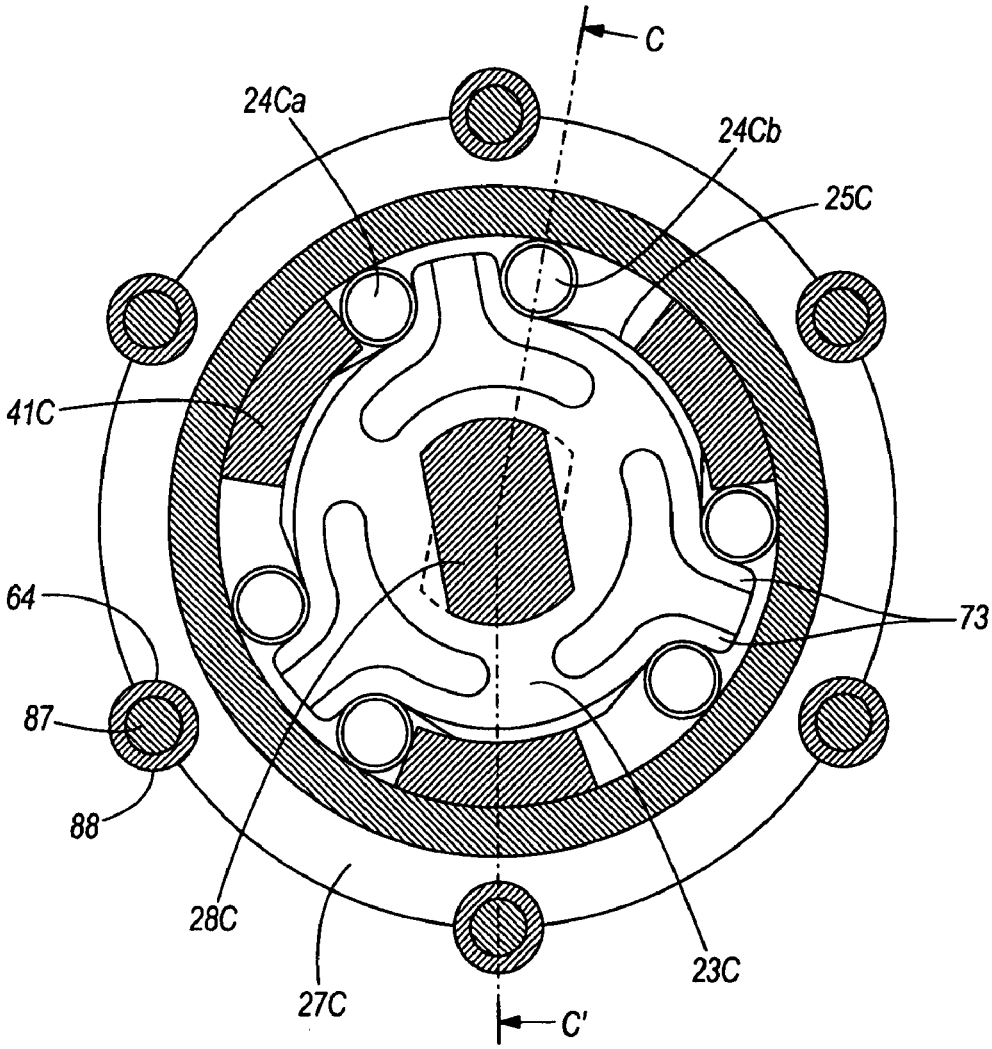
FIG. 14 is a partial cross-sectional view taken generally along line A–A' in FIG. 12.

As shown in FIG. 14, the supporting ring 23C is similar to the supporting ring 23B and includes elastic arms 73C to support the wedge rollers 24C (maintaining their alignment and synchronizing their locking action).

As also shown in FIG. 14, the fixing ring 27C defines retaining recesses 64C which receive pins 87 connected to the fixing element 53C to connect the fixing ring 27C to the fixing element 53C. Elastic material 88 is positioned between the recesses 64C and the pins 87 to absorb any impact caused by the spindle lock 10C engaging and preventing such an impact from being transferred from the fixing ring 27C and to the fixing element 53C. The elastic material 88 can be any type of rubber or elastic material to absorb an impact.

Figure 15:
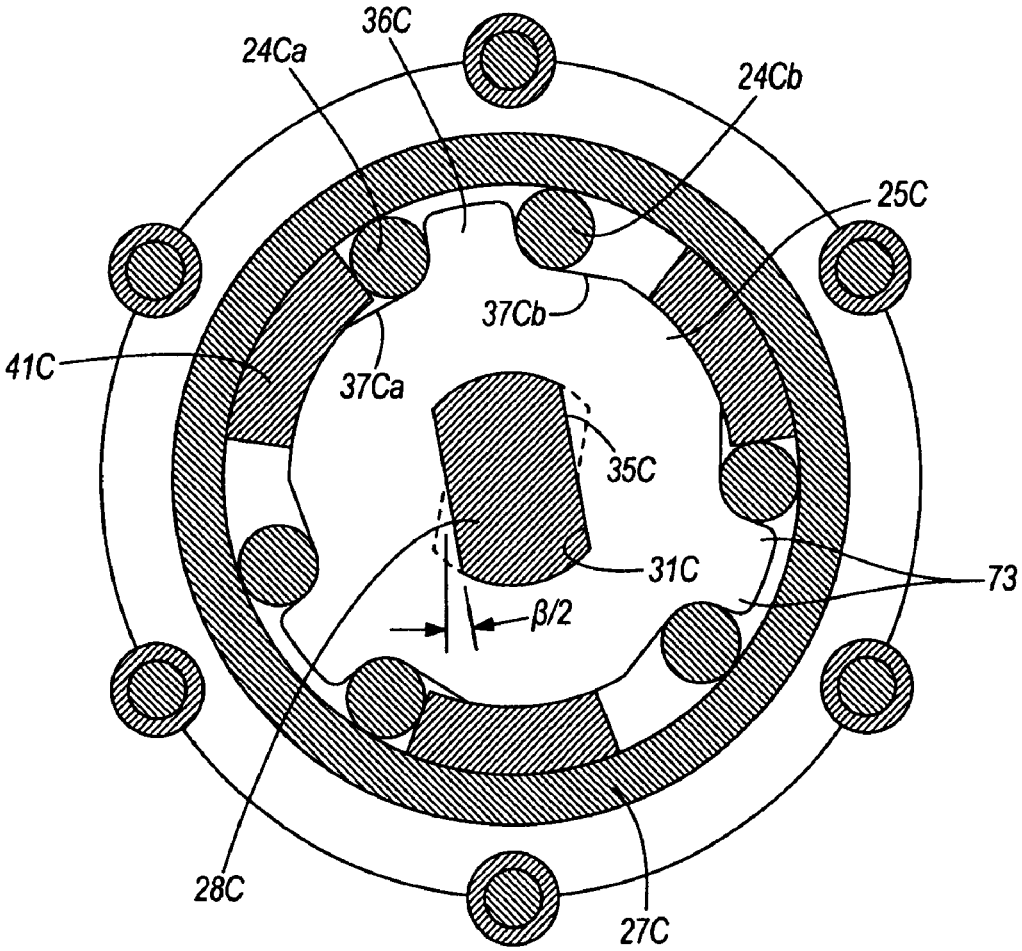
FIG. 15 is a partial cross-sectional view taken along line B–B' in FIG. 12.

As shown in FIG. 15, the connecting part 35C of the lock ring 25C and the connecting part 31C of the spindle 28C are formed such that there is a free rotational angle $\alpha$ between the connecting part 31C of the spindle 28C and the connecting part 35C of the locking ring 25C. In the illustrated construction, this free rotational angle $\alpha$ is smaller (i.e., an angle of about 10 degrees) than the free rotational angle $\alpha$ (an angle of about 20 degrees) between the connecting part 32C of the carrier 15C and the connecting part 31C of the spindle 28C. The free rotational angle $\alpha$ allows the locking ring 25C to be easily connected to the spindle 28 while maintaining the proper operation of the spindle lock 10C.

Figure 16:
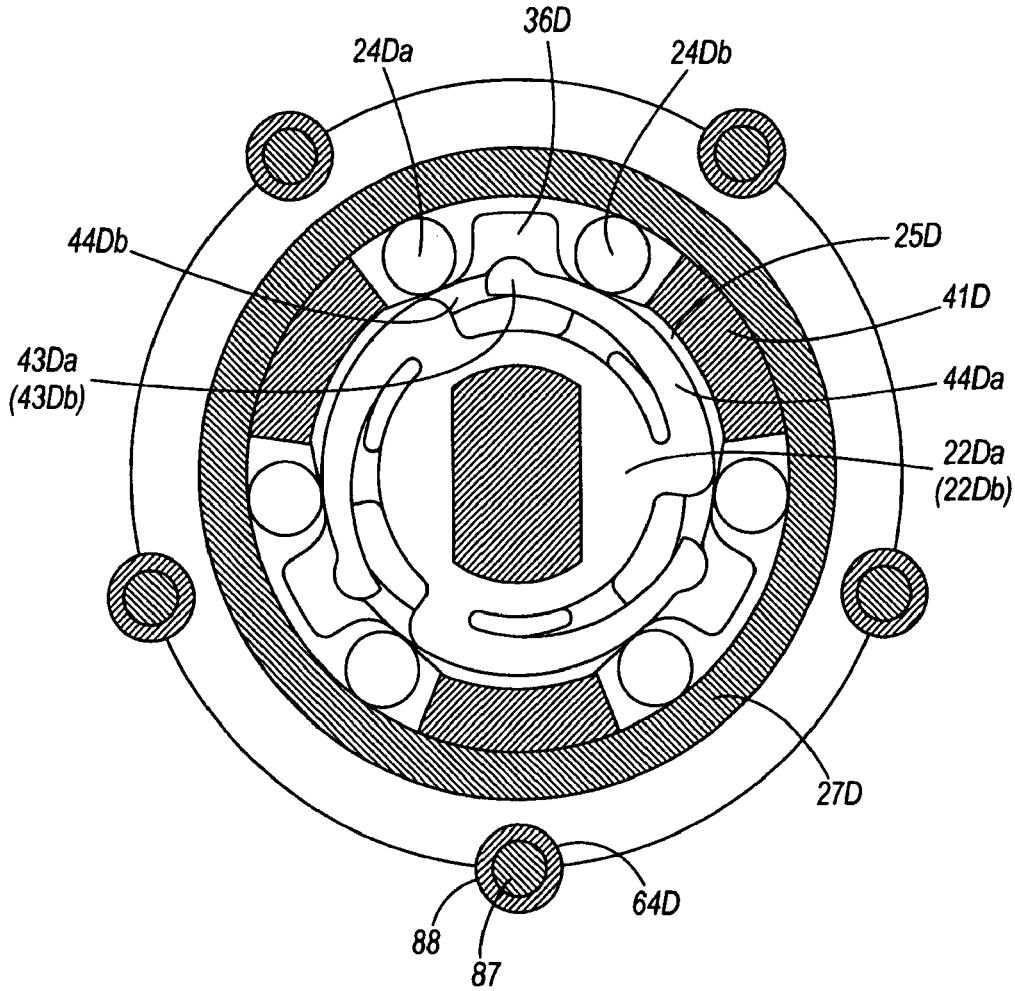
FIG. 16 is a partial cross-sectional view of a second alternative construction of the rotation controlling structure of the spindle lock system.
Figure 17:
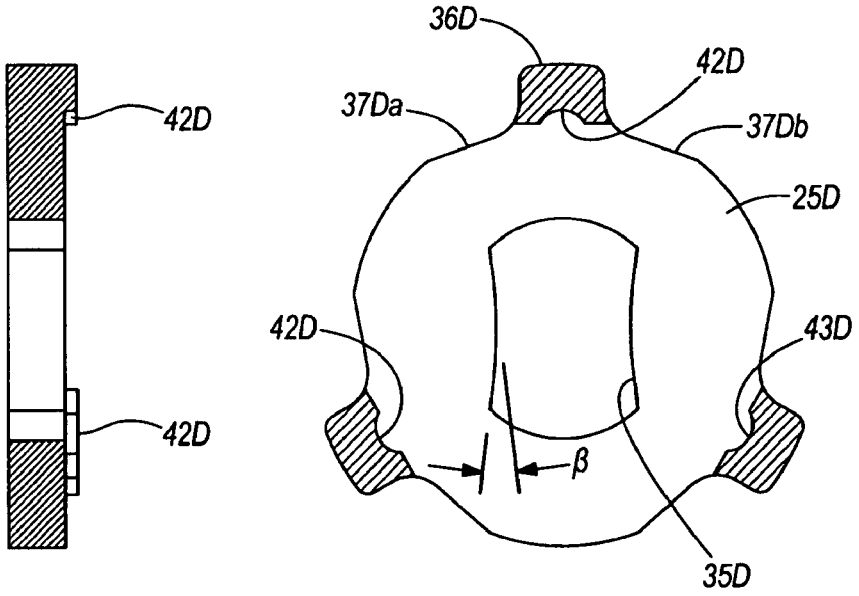
FIG. 17 are partial cross-sectional views of a portion of the spindle lock system shown in FIG. 16.

FIGS. 16–17 show a second alternative construction of the rotation controlling structure of a spindle lock 10D. Common elements are identified by the same reference number "D".

In the illustrated construction, the rotational control structure includes a single recess 42D for each projection 43C (rather than the two recesses 42*a* and 42*b* of earlier-described constructions). Each recess 42D is formed in a location corresponding to an unlocked position of the wedge rollers 24D. As shown in more detail in FIG. 17, the recesses 42D are formed on the dividing protrusion 36D of the locking ring 25D. In this construction, the snap ring 22D includes two snap ring elements 22Da and 22Db supported in reversed orientations, and the snap ring 22D (formed of snap ring elements 22Da and 22Db) engages the locking ring 25D.

In operation, when the spindle 28D is rotated relative to the driving engagement (the connection between the spindle 28D and the carrier 15D), the continued rotation of the spindle 28D causes the projections 43D to move from the recesses 42D. The resilient force applied by the snap arms 44D and this movement delays the engagement of the wedge rollers 24D with the wedge surfaces defined by the locking ring 25D and the fixing ring 27D.

The snap ring 22D controls and buffers the movement of the spindle 28D and delays the movement of the wedge rollers 24D and the locking ring 25D to the locked position. In this construction, when the motor M is stopped and the spindle 28D continues its rotation under inertia, the locking ring 25D operates the wedge rollers 24D (in the selected rotational direction) to lock the rotation of the spindle 28D. The inertia of the spindle 28D is controlled and buffered by the resilient force of the snap arms 44Da and 44Db so that there is no impact or "clunk" caused by a sudden stop when the spindle lock 10D is engaged. Therefore, the spindle lock 10D provides a quiet stop of the rotation of the spindle 28D. Even if the inertia of the spindle 28D is larger than can be buffered by the resilient force of the snap ring 22D, the rotation of the spindle 28D is stopped at an early stage so that there is no rebounding of the spindle 28D and no "chattering".

In this construction, the connecting part 35D of the locking ring 25D and the connecting part 31D of the spindle 28D also include a free rotational angle $\alpha$, similar to that described above.

Figure 18:
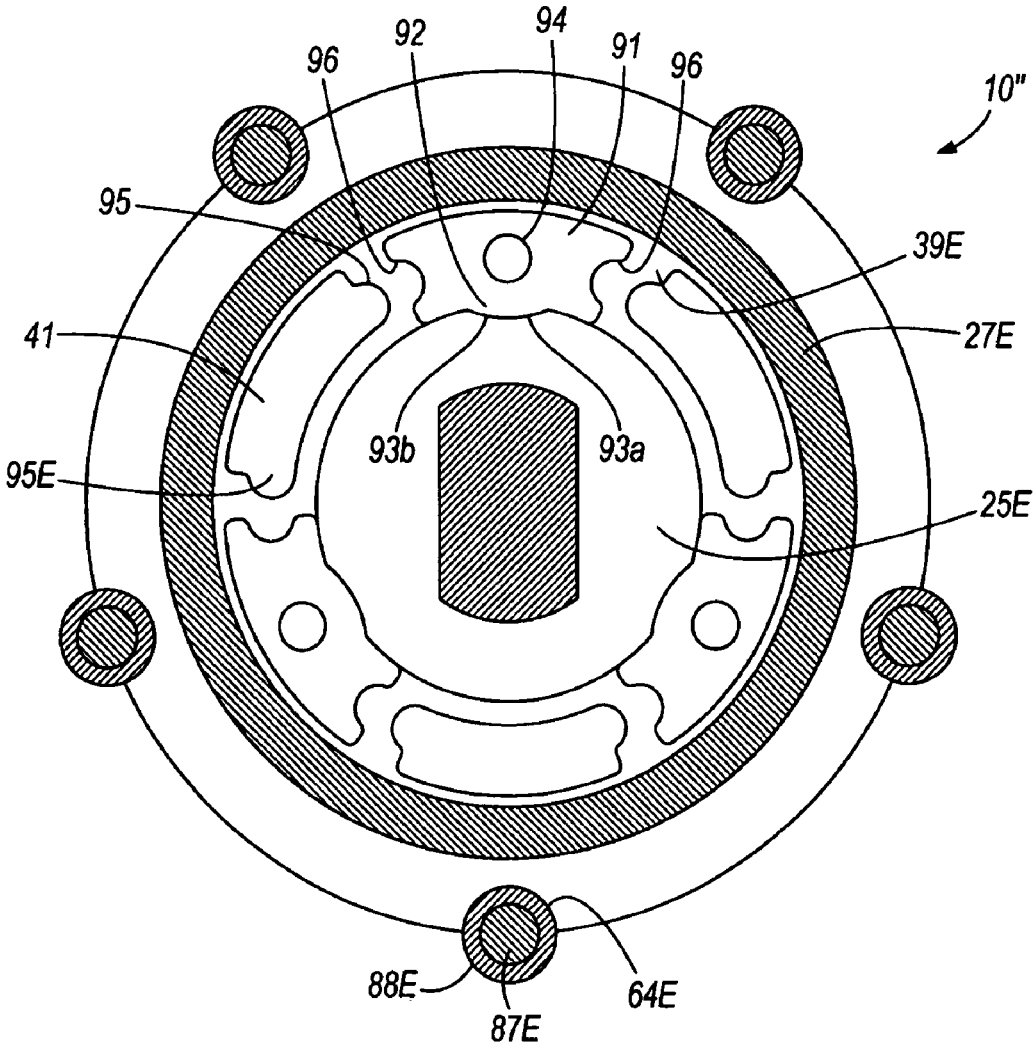
FIG. 18 is a partial cross-sectional view of an alternative construction of the locking structure of the spindle lock system.
Figure 19:
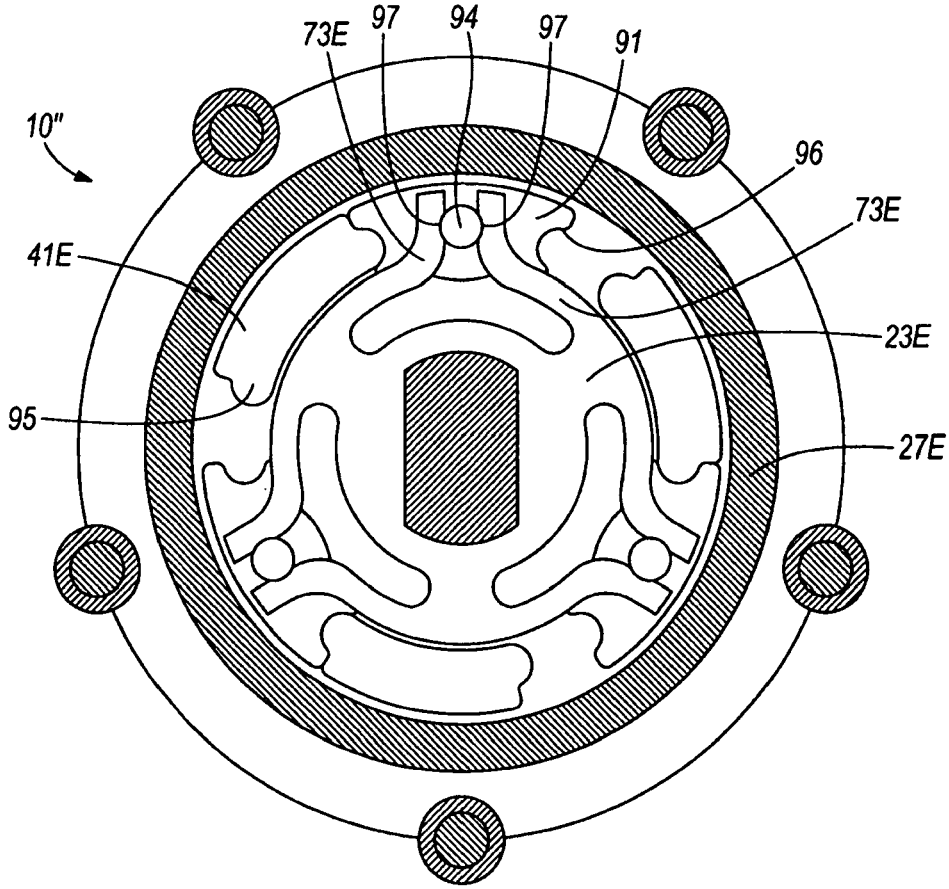
FIG. 19 is a partial cross-sectional view of the spindle lock system shown in FIG. 18 and illustrating the operating condition of the spindle lock system.
Figure 22:
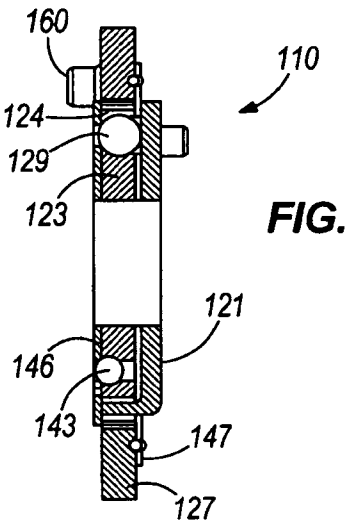
FIG. 22 is a cross-sectional view taken along line D–D' in FIG. 21 and including the spring plate.

FIGS. 18–19 show an alternative construction of the locking structure 10E' of a spindle lock 10E. Common elements are identified by the same reference number "E".

In this construction, the locking structure 10E' includes locking elements, such as brake shoes 91, which are engageable between the inner circumference 39E of the fixing ring 27E and the outer circumference of the locking ring 25E to provide a locking and wedging action. Each brake shoe 91 is formed of a suitable frictional material, such as a metallic material, and the outer surface of each brake shoe 91 and the inner circumference 39E of the fixing ring 27E may be provided with inter-engaging projections and recesses, such as a serrated or pawl surfaces to provide a larger frictional resistance between the brake shoe 91 and the fixing ring 27E.

Each brake shoe 91 includes a centrally-located inner cam 92. On the outer circumference of the locking ring 25D, a corresponding recess portion receives each projecting cam 92 (in the unlocked position of the brake shoe 91). Raised cam surfaces 93*a* and 93*b* are provided on each side of this recessed portion to engage the projecting cam 92 (in either rotational direction) to force the brake shoe 91 to the locked position, in which the brake shoe 91 engages the inner circumference 39E of the fixing ring 27E.

In the illustrated construction, continued rotation of the spindle 28E, causes the locking ring 25E to rotate so that, in the selected direction, the raised cam surfaces 93*a* and 93*b* engage the projecting cam 92 to press the brake shoe 91 against the inner circumference 39E of the fixing ring 27E to stop the rotation of the spindle 28E. Locking and releasing of the brake shoes 91 is accomplished within the free rotational angle a between the spindle 28E and the carrier 15E.

A releasing protrusion 41E is provided between each brake shoe 91. The releasing protrusions 41E are driven by the carrier 15E and selectively engage the circumferential end portion of each brake shoe 91 to move the brake shoe 91 from the locked position to the unlocked position. On the circumferential end part of each releasing protrusion 41E and brake shoe 91, inter-engaging projections 95 and recesses 96 are formed. When these elements 95 and 96 are engaged, each brake shoe 91 is positioned in an unlocked position in which the outer circumference of the brake shoe 91 is radially spaced from the inner circumference 39E of the fixing ring 27E.

Each brake shoe 91 also includes a centrally-located axially-extending pin 94. The supporting ring 23E (which rotates with the spindle 28E) includes a pair of arms 73E which receive the pin 94. Recesses 97 are formed in each arm 73E for retaining the pin 94 in a unlocked position in which the outer circumference of the brake shoe 91 is spaced from the inner circumference 39E of the fixing ring 27E.

From the locked position of the locking structure 10E', the motor M is operated so that the carrier 15E moves the releasing protrusions 41E to engage the elements 95 and 96 and move the brake shoe 91 to the unlocked position. During this movement, the pin 94 is moved to engage the retaining recesses 97 formed between the arms 73E of the supporting ring 23E, and the brake shoe 91 is thus retained in the unlocked position radially spaced from the inner circumference 39E of the fixing ring 27E. The brake shoe 91 is retained in this unlocked position by engagement on one end by the releasing projection 41E and at the center by engagement of the pin 94 with the retaining recesses 97. In this unlocked position, because the brake shoes 91 are retained in a radially spaced position from the inner circumference 39E of the fixing ring 27E, there will not be inadvertent engagement of the brake shoe 91 with the fixing ring 27E so that no "scraping" sound will result during driving of the spindle 28E.

It should be understood, that in some aspects of the invention, the locking device 10" may include the wedge roller-type locking assembly, the brake shoe assembly or some other type of locking assembly.

It should be understood that, in some constructions (not shown), the controlling force applied by the snap ring 22 to maintain the projection 43 in the selected recess 42 may be applied in another direction (i.e., radially-inwardly or axially). It should also be understood that, in other constructions (not shown), the projection 43 may be formed separately from but engageable with the snap arm 44 so that the snap arm 44 applies a force to engage the projection 43 in the selected recess 42.

In accordance with the present invention, the resilient force provided by the rotation controlling device (including the snap ring 22 and the engagement between the projection 43 and the selected recess 42) controls and buffers the rotational inertia of the spindle 28 (and the chuck 120 and/or supported bit 124).

When the rotational inertia of the spindle 28 (and the chuck 120 and/or supported bit 124) is large, the resilient force applied by the snap ring 22 controls and buffers this increased rotational inertia so that no impact or "clunk" is caused when the spindle lock 10 engages to stop the rotation of the spindle 28.

When the rotational inertia of the spindle 28 (and the chuck 120 and/or the drill bit 124) is much greater than the resilient force of the snap ring 22 and even when the spindle 28 may rebound, the resilient force of the snap ring 22 buffers the rotational inertia at an early stage in the continued rotation of the spindle 28, greatly reducing this rotational force so that the spindle 28 does not impact and rebound and so that no "clunk" or "chattering" is caused during engagement of the spindle lock 10. With the present invention, the spindle lock provides a quiet stopping of the spindle 28 (no "clunk" or "chattering") and reduces any damage which might be caused to the components of the spindle lock 10 and the power tool.

The spindle lock 10 of the present invention provides for smooth constant locking and unlocking of the locking structure 10" and smooth and constant operation of the power tool.

FIGS. 20–31B illustrate another construction of the spindle lock system similar in many ways to the illustrated constructions of FIGS. 1–19 described above. Accordingly, with the exception of mutually inconsistent features and elements between the construction of FIGS. 20–31B and the constructions of FIGS. 1–19, reference is hereby made to the description above accompanying the constructions of FIGS. 1–19 for a more complete description of the features and elements (and the alternatives to the features and elements) of the construction of FIGS. 20–31B. Features and elements in the construction of FIGS. 20–31B corresponding to features and elements in the constructions of FIGS. 1–19 are numbered in the 100 and 200 series.

Figure 26A:
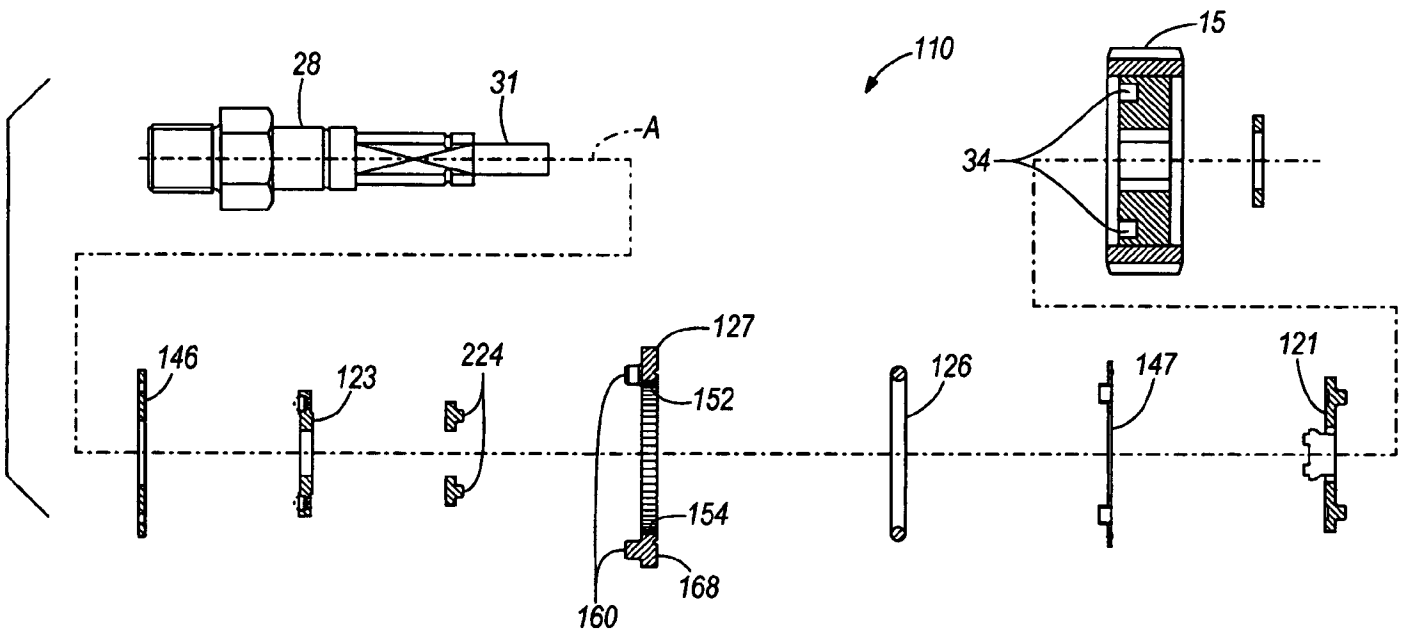
FIG. 26A is an exploded partial cross-sectional side view of the spindle lock system shown in FIG. 20.
Figure 26B:
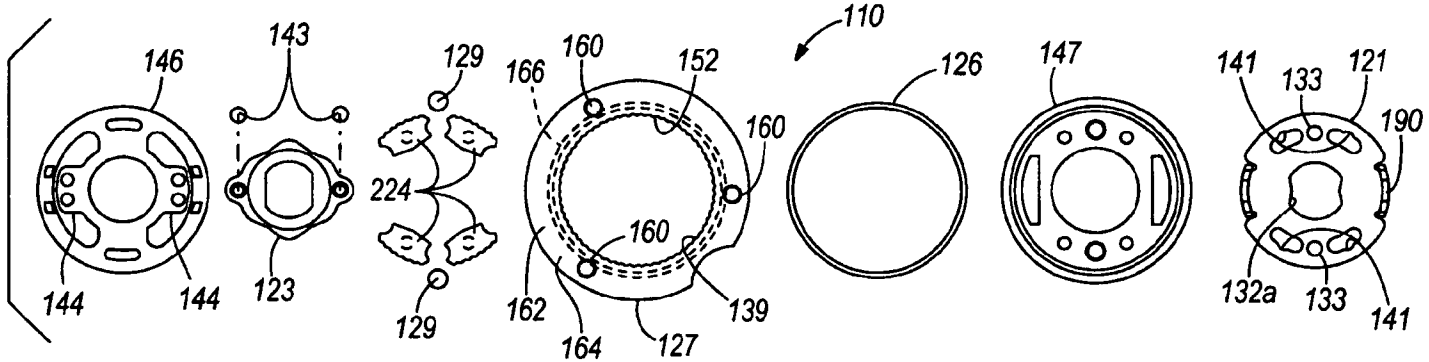
FIG. 26B is an exploded side view of the spindle lock system shown in FIG. 20.

As shown in FIGS. 26A and 26B, the spindle lock system 110 is supportable on a spindle 28 of a power tool 100 and includes a driving engagement for conveying the output force of the motor M to the spindle 28. As described in greater detail below, the spindle lock system 110 also includes a locking structure for locking the spindle 28 and selectively preventing rotation of the spindle 28 relative to the housing 104 and relative to the carrier 15 and motor M.

The locking structure may generally include a release ring 121, a driver or support ring 123, an elastic ring or drag element 126, a locking or fixing ring 127, rollers 129, a spring 146, a delay plate 147 and one or more locking members or wedges 224. Each of the elastic ring 126, fixing ring 127, spring 146 and delay plate 147 are generally in the shape of a ring extending about the same axis, such as the axis A of the spindle 28.

Figure 27C:
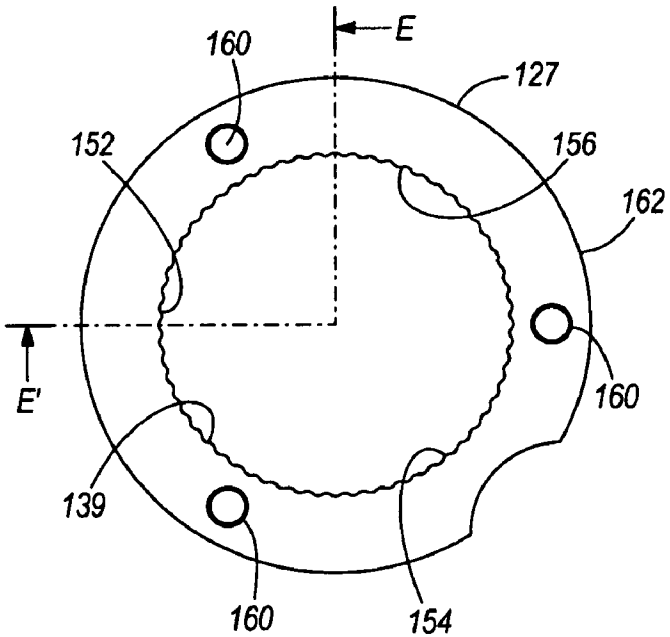
FIG. 27C is a rear view of a lock ring of the spindle lock system shown in FIG. 20.
Figure 27B:
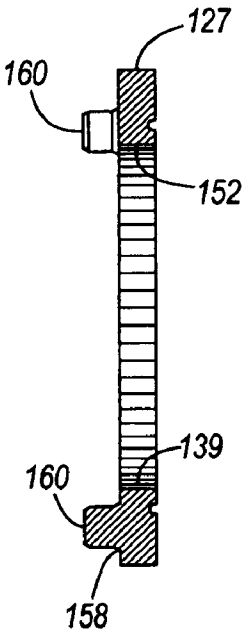
FIG. 27B is a cross-sectional view taken along line E–E' in FIG. 27A.
Figure 27A:
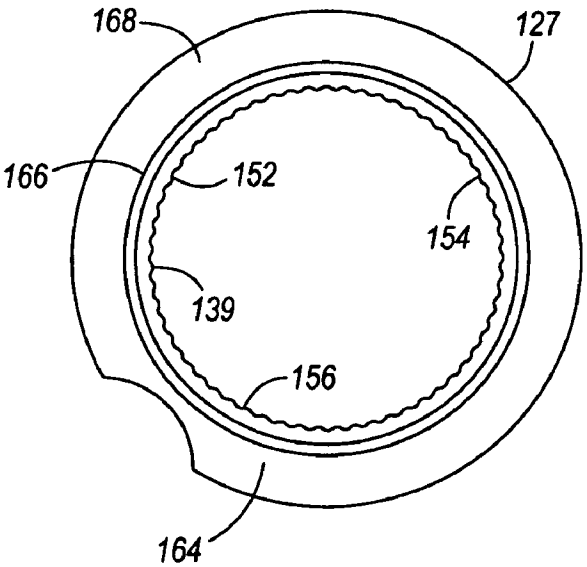
FIG. 27A is a front view of a lock ring of the spindle lock system shown in FIG. 20.
Figure 28A:
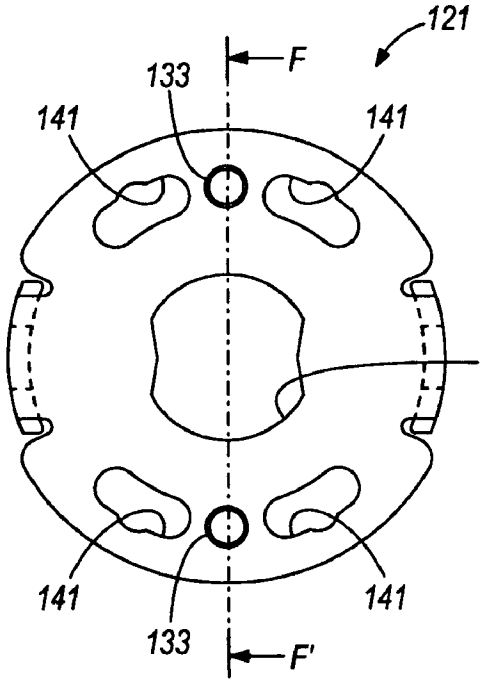
FIG. 28A is a rear view of a release ring of the spindle lock system shown in FIG. 20.
Figure 28B:
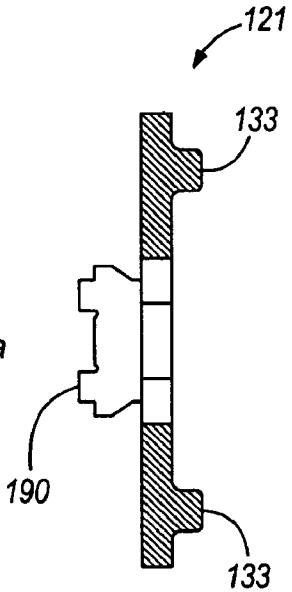
FIG. 28B is a cross-sectional view taken along line F–F' in FIG. 28A.
Figure 28C:
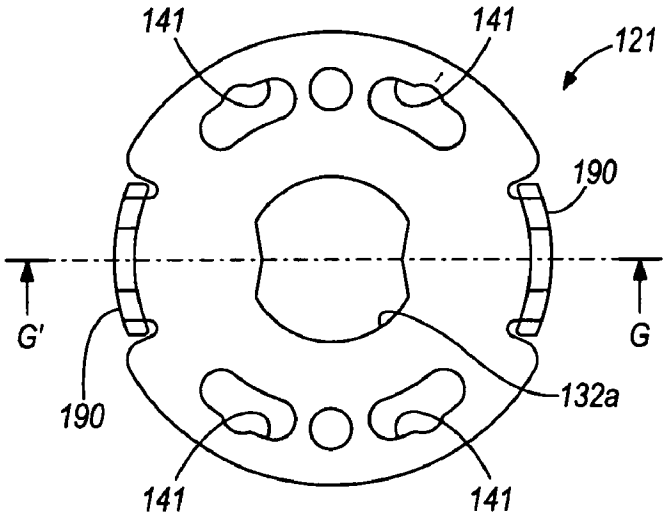
FIG. 28C is a front view of the release ring of the spindle lock system shown in FIG. 28A.
Figure 28D:
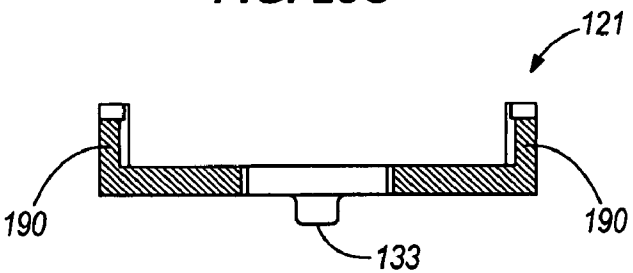
FIG. 28D is a cross-sectional view taken along line G–G' in FIG. 28C.

As shown in FIGS. 27A–C, the fixing ring 127 is supportable in the housing 104 of a power tool (e.g., the power tools 100, 200 or 300) and includes forwardly extending protrusions 160 located along a front face 162. The protrusions 160 are engageable in corresponding recesses (not shown) located along the interior of the housing 104 to secure the fixing ring 127 in the housing 104 and to prevent movement of the fixing ring 127 with respect to the housing 104 (i.e., rotation about the spindle axis A). In other constructions (not shown), the fixing ring 127 can include recesses, and the housing 104 can include correspondingly shaped protrusions for engagement in the recesses of the fixing ring 127 to secure the fixing ring 127 in the housing 104 and to prevent rotation of the fixing ring 127 with respect to the housing 104. In yet another construction (not shown), the fixing ring 127 and the housing 104 may include other inter-engaging structure to substantially prevent relative rotation of the fixing ring 127 and the housing 104.

An inner wall 152 of the fixing ring 127 defines a cavity 139 for receiving or supporting the support ring 123 and wedges 224. The inner wall 152 also defines a locking surface 154 extending circumferentially around the cavity 139. In some aspects and in the illustrated construction, a number of teeth 156 are defined along the inner wall 152 and extend radially inwardly into the cavity 139. As described in greater detail below, in constructions of the fixing ring 127 having teeth 156, the teeth 156 are engageable with corresponding teeth 180 defined on exterior surfaces of the wedges 224.

Figure 29C:
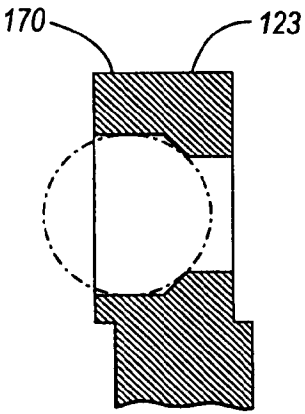
FIG. 29C is an enlarged partial cross sectional view of a portion of the support ring shown in FIG. 29A.
Figure 29B:
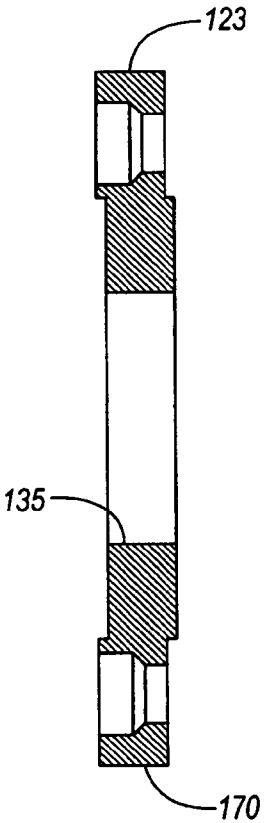
FIG. 29B is a cross-sectional view taken along line H–H' in FIG. 29A.
Figure 29A:
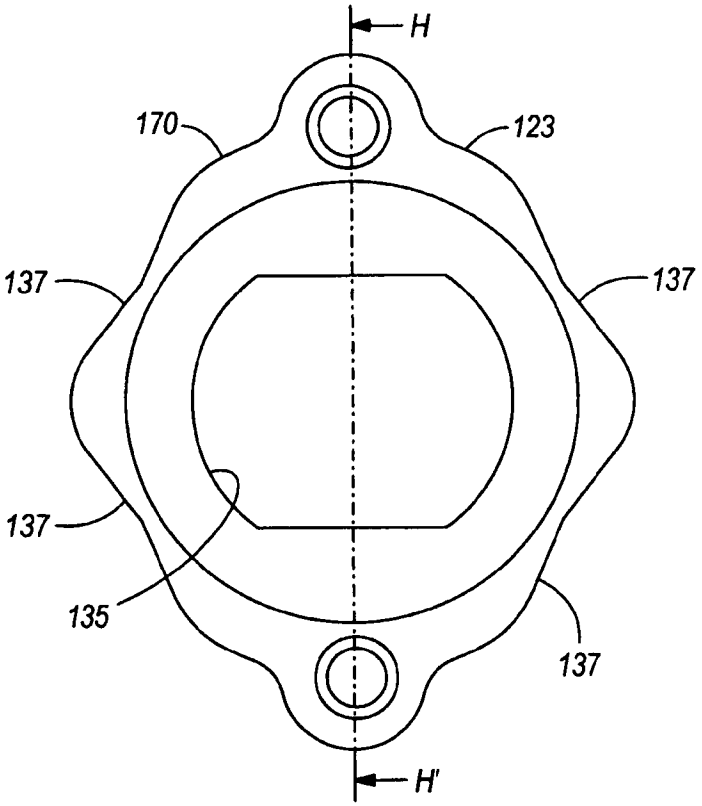
FIG. 29A is a front view of a support ring of the spindle lock system shown in FIG. 20.

As shown in FIGS. 29A–C, a hole-shaped connecting part 135 extends axially through a central portion of the support ring 123 and has a substantially similar configuration to the connector 31 on the spindle 28. More particularly, the hole-shaped connecting part 135 includes one or more flat sides (e.g., one, two, three, etc.) for engagement with one or more corresponding flat sides of the connector 31. In this manner, the support ring 123 is fixable to and rotatable with the spindle 28 as the spindle 28 rotates in the forward and reverse rotational directions, respectively.

The outer surface 170 of the support ring 123 includes wedging surfaces 137 which, in the illustrated construction, are spaced from each other by about 90 degrees to correspond with the relative position of the wedges 224. As explained in greater detail below, the wedging surfaces 137 are contoured to provide locking surfaces which cooperate with the wedges 224 to lock the spindle 28 and to prevent rotation of the spindle 28 about the spindle axis A in the forward and reverse rotational directions. Each wedging surface 137 is designated to lock an associated wedge 224 by engagement with the corresponding radially inwardly facing side 182 (see FIG. 30A) of the wedge 224 to force the wedge 224 radially outwardly into locking engagement with the fixing ring 127.

The inner circumference of the fixing ring 127 and the outer perimeter of the support ring 123 (and/or of the spindle 28) face each other in a radial direction and are spaced a radial distance such that a number of wedges 224 (e.g., four wedges in the illustrated construction) are insertable between the fixing ring 127 and the support ring 123. A wedge 224 is provided for each wedging surface 137 of the support ring 123.

Figure 30B:
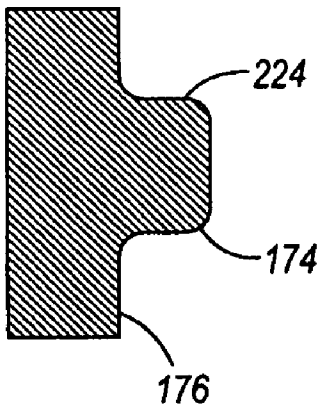
FIG. 30B is a cross-sectional view taken along line I–I' in FIG. 30A.
Figure 30A:
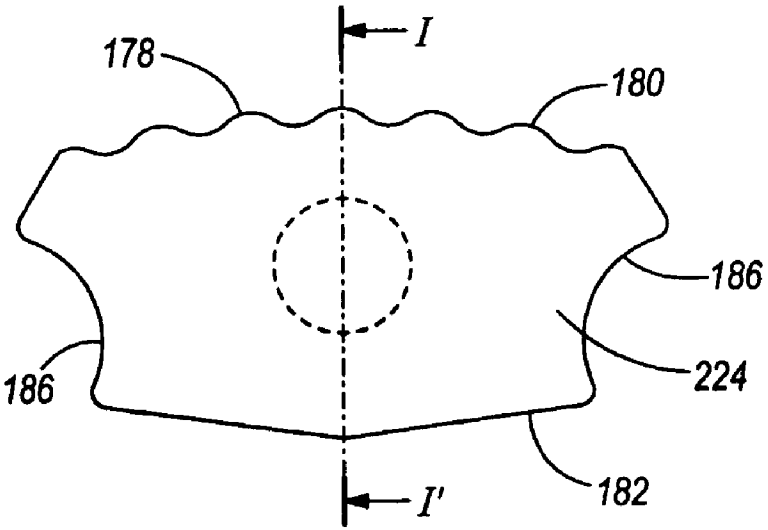
FIG. 30A is a rear view of a wedge of the spindle lock system shown in FIG. 20.

In the illustrated construction, the wedges 224 have generally rectangular cross sectional shapes (see FIGS. 30A and 30B). Protrusions 174 extend axially from rearward surfaces 176 of the wedges 224. Radially outwardly facing sides 178 of the wedges 224 define locking surfaces and in some constructions, such as in the illustrated construction, include teeth 180. Radially inwardly facing sides 182 of the wedges 224 are contoured and define camming surfaces which are engageable with corresponding wedging surfaces 137 of the support ring 123 to transfer relative rotational movement of the support ring 123 to radial movement of the wedges 224. The ends 186 of the wedges 224 are contoured and support rollers 129 for rotation about the spindle axis A and for movement with the wedges 224 in the cavity 139 between the first locking surface 154 of the fixing ring 127 and the wedging surfaces 137 of the support ring 123.

As shown in FIGS. 28A-D, the release ring or alignment member 121 includes pins 133 on opposite sides of the spindle axis A which are engaged and retained in connecting holes 34 formed on the carrier 15 so that the release ring 121 is fixed to and rotatable with the carrier 15. The release ring 121 defines a hole-shaped connector 132*a* which is substantially identical to the connector 35 formed in the carrier 15 to provide the free rotational angle $\alpha$ between the spindle 28 and the carrier 15 and the release ring 121.

Releasing apertures 141 extend axially through the release ring 121 and define camming surfaces which extend along the outer periphery of the releasing apertures 141. The releasing apertures 141 are separated by about 90 degrees to correspond with the relative positions of the wedges 224 and the wedging surfaces 137. Each camming surface is configured to release or unlock an associated wedge 224 by engagement with the protrusions 174 of the wedge 224 to force the wedge 224 radially inwardly toward the spindle axis A and out of engagement with the fixing ring 127. During locking, the protrusions 174 of the wedges 224 move circumferentially along the camming surfaces and move radially outwardly. In this manner, the wedges 224 move radially outwardly into engagement with the locking surface 154 of the fixing ring 127. The circumferential length of each releasing aperture 141 is defined so that the releasing or unlocking function is accomplished within the free rotational angle $\alpha$ between the spindle 28 and the release ring 121. Preferably, the releasing or unlocking function is accomplished near the end of the free rotational angle $\alpha$.

The releasing apertures 141 and the circumferential spacing of the releasing apertures 141 around the release ring 121 synchronize movement of the wedges 224 so that the wedges 224 move together between respective locked or retaining positions and unlocked or releasing positions. The releasing apertures 141 and the camming surfaces also maintain the relative orientation of the wedges 224 with respect to the fixing ring 127 and the support ring 123. More specifically, the engagement of the protrusions 174 and the releasing apertures 141 maintains the wedges 224 in an orientation in which wedge axes extending through the protrusions 174 of the wedges 224 are substantially parallel to the spindle axis A.

The wedging surfaces 137 of the support ring 123 and, in some cases, the camming surfaces of the release ring 121 cooperate to wedge the wedges 224 in place in respective locked or retaining positions which correspond to a locked condition of the spindle lock system 110, in which the spindle 28 is prevented from rotating relative to the housing 104 and relative to the motor M and carrier 15. During releasing or unlocking, the camming surfaces of the release ring 121 and, in some cases, the wedging surfaces 137 of the support ring 123, move the wedges 224 radially inwardly and out of engagement with the locking surface 154 of the fixing ring 127 and toward the spindle axis A to a releasing or unlocked position which corresponds to an unlocked condition of the spindle lock system 110, in which the spindle 28 is free to rotate relative to the housing 104. In addition, the releasing apertures 141 have a circumferential dimension allowing the wedges 224 to be supported in the releasing or unlocked position.

Figure 21:
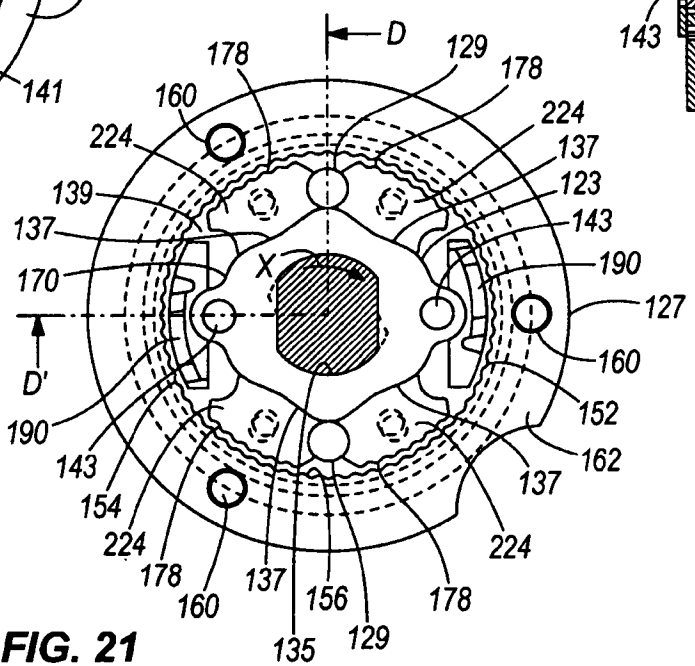
FIG. 21 is a front view of the construction of the spindle lock system shown in FIG. 20 in a unlocked position with the spring plate removed.
Figure 20:
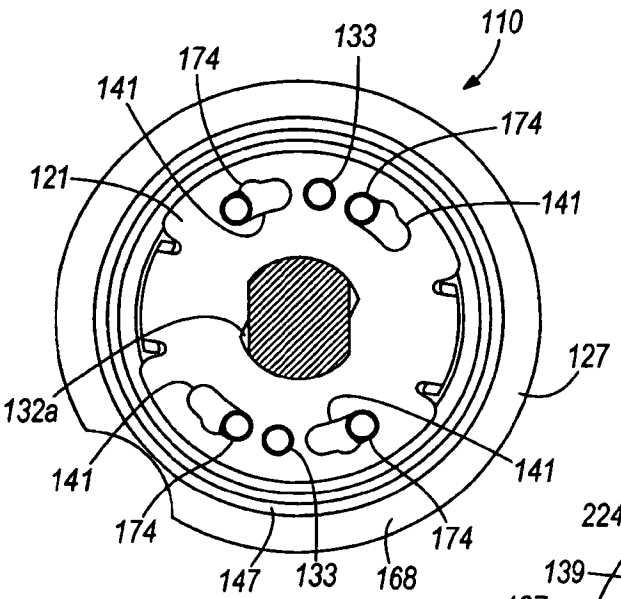
FIG. 20 is a rear view of an alternate construction of a spindle lock system of the present invention shown in a unlocked position.
Figure 25:
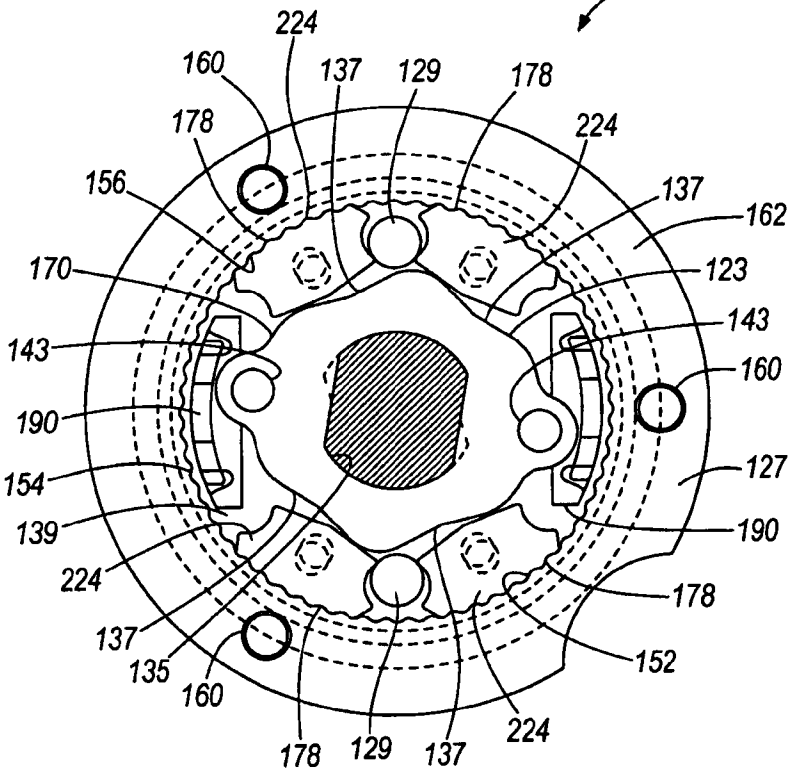
FIG. 25 is a front view of the construction of the spindle lock system shown in FIG. 20 in a locked position and with the spring plate removed.
Figure 24:
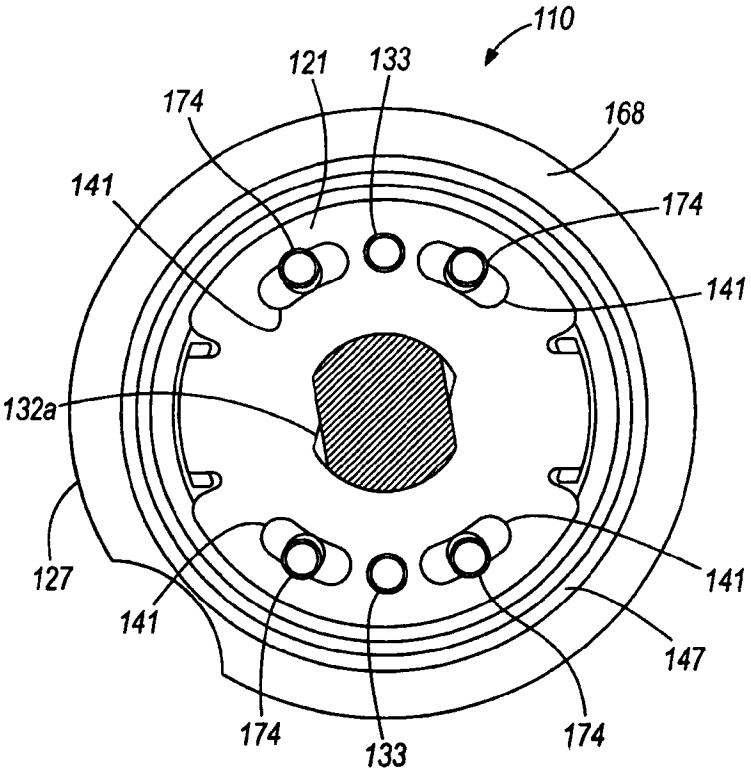
FIG. 24 is a rear view of the spindle lock system shown in FIG. 20 in a locked position.

Legs 190 extend axially from a rearward side of the release ring 121 into the cavity 139 of the fixing ring 127 and are spaced circumferentially around the release ring 121 by about 180 degrees. As shown in FIGS. 21 and 25, the legs 190 extend between two pairs of wedges 224 to avoid interfering with the wedges 224 as the wedges 224 move radially between releasing or unlocked positions and locked or retaining positions.

Figure 23:
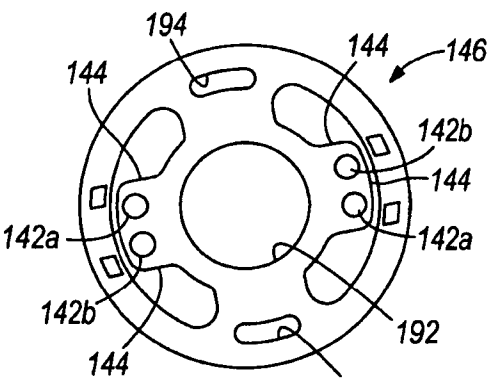
FIG. 23 is a front view of a spring plate of the spindle lock system shown in FIG. 20.

The spring plate 146 is supported on the front face 162 of the locking ring 127 and is secured to the legs 190 of the release ring 121 for rotation with the release ring 121 about the spindle axis A. As shown in FIG. 23, a central opening 192 of the spring plate 146 is generally circular so that the spring plate 146 is rotatable relative to the spindle 28. Positioning apertures 194 are spaced circumferentially around the spring plate 146 by about 180 degrees and are radially spaced from the central opening 192 to at least partially support rollers 129 for circumferential movement in the recess 152.

The spring plate 146 defines one portion of a detent arrangement or controlling structure for controlling movement of the wedges 224 between respective releasing or unlocked positions and respective locked or retaining positions and for controlling the resilient force of the spring plate 146 between a detent position corresponding to the unlocked condition of the spindle lock system 110 and a detent position corresponding to the locked condition of the spindle lock system 110. The spring plate 146 includes two snap arms 144 spaced circumferentially around a central portion of the spring plate 146 by about 180 degrees. As shown in FIG. 26B, the snap arms 144 extend radially outwardly across the support ring 123 between pairs of wedges 224. In the illustrated construction (see FIG. 23), controlling recesses 142*a* and 142*b* extend axially through each of the snap arms 144.

As shown in FIGS. 21, 25 and 26B, projections 143, in the form of balls or rollers, each having a controlling convex surface, are supported on a forward face of the supporting ring 123. In the illustrated construction, the projections 143 are equally separated around the circumference of the supporting ring 123 by about 180 degrees. The projections 143 provide the second portion of the detent arrangement and are selectively engageable in one of a pair of corresponding recesses 142*a*, 142*b*. The snap arms 144 provide a resilient force in an axial direction to bias the projections 143 into engagement with a selected one of the recesses 142*a*, 142*b*. The resilient spring force on the projections 143 is provided by the elasticity of and material characteristics of the snap arms 144.

The resilient force of the snap arms 144 is smaller than the drive force of the motor M and will allow the projections 143 to move from one recess (i.e., recess 142*b*) to the other recess (i.e., recess 142*a*) when the motor M is restarted. The resilient force the snap arms 144 apply to the projections 144 is selected to allow the projections 143 to move from one recess (i.e., 142*a*) to the other recess (i.e., 142*b*) to control and buffer the rotational force of the spindle 28 when the motor M is stopped and to delay the engagement of the locking structure.

Figure 31B:
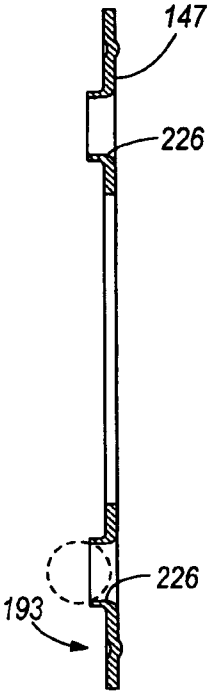
FIG. 31B is a cross-sectional view taken along line J–J' in FIG. 31A.
Figure 31A:
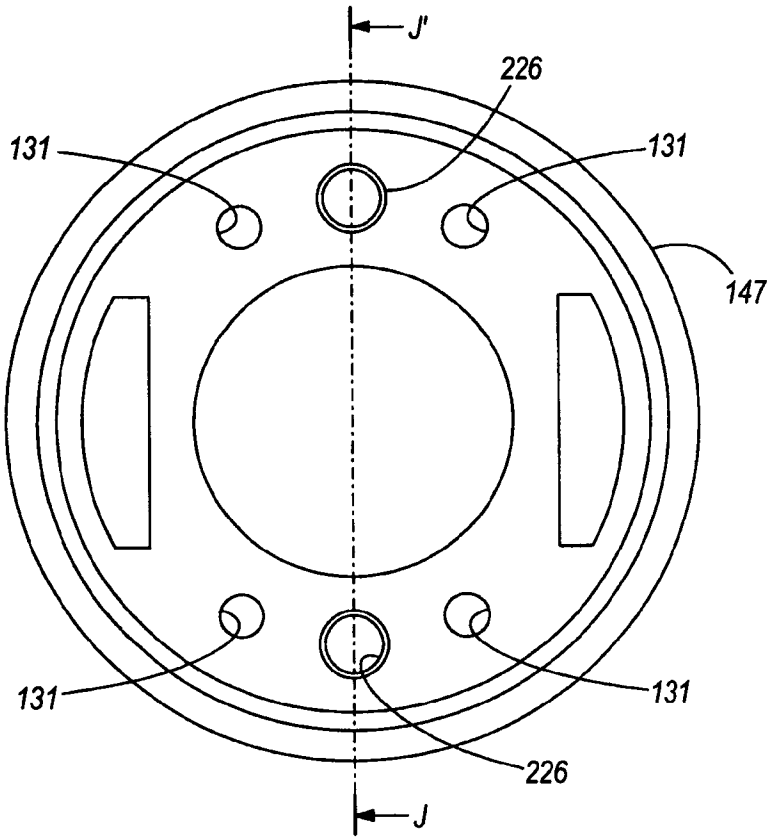
FIG. 31A is a rear view of a drag plate of the spindle lock system shown in FIG. 20.

The delay plate 147 is secured between the fixing ring 127 and the release ring 121 for rotation with the release ring 121 and the spindle 28 about the spindle axis A. As shown in FIGS. 31A and 31B, egg-shaped apertures 131 extend axially through the delay plate 147 and are spaced circumferentially around the delay plate 147. In the illustrated construction, the delay plate 147 includes four egg-shaped apertures 131 spaced circumferentially around the delay plate 147 by about 90 degrees to correspond with the relative positions of the wedges 224 and the wedging surfaces 137 of the releasing ring 123. The protrusions 174 of the wedges 224 extend axially through the egg-shaped apertures 131 and the releasing apertures 141 of the releasing ring 121 and are supported by the delay plate 147 and the releasing ring 121 in the cavity 139.

Circular apertures 226 extend axially through the delay plate 147 and are spaced circumferentially around the delay plate 147 by about 180 degrees between pairs of the egg-shaped apertures 131 to support rollers 129 for circumferential movement in the recess 152. Together, the positioning apertures 194 of the spring plate 144 and the circular apertures 226 of the delay plate 147 restrict radial movement of the rollers 129 while allowing limited circumferential movement of the rollers 129 relative to the spring plate 146 and the delay plate 147.

A rear face 168 of the fixing ring 127 defines a drag surface 164 (see FIG. 27A). The elastic ring or drag member 126 is supported in a groove 166 extending circumferentially around the rear face 168 of the fixing ring 127 and in a contoured pocket or recess 193 (see FIG. 31B) formed in the delay plate 147. Frictional engagement between the elastic ring 126 and the fixing ring 127 resists rotation of the support ring 123 about the spindle axis A with respect to the fixing ring 127 when a rotational force is applied to the spindle 28 to cause the spindle 28 to rotate relative to the driving connection. Frictional engagement between the elastic ring 126 and the fixing ring 127 also resists rotation of the support ring 123 about the spindle axis A with respect to the fixing ring 127 when the rotational force is removed from the spindle 28.

In the illustrated construction, the elastic ring 126 is a substantially circular member made of an elastomeric material having a relatively smooth outer surface. In other constructions (not shown), the elastic ring 126 can include a thrust bearing and/or springs for biasing the elastic ring 126 into frictional engagement with the drag surface 164 of the fixing ring 127. In still other constructions, one or both of the elastic ring 126 and the drag surface 164 of the fixing ring 127 can include protrusions or fingers for frictional engagement in corresponding recesses or grooves located along the other of the elastic ring 126 and the drag surface 164 of the fixing ring 127. In other constructions, one or both of the elastic ring 126 and the drag surface 164 of the fixing ring 127 can include textured (e.g., knurled, contoured, ribbed, etc.) outer surfaces.

In yet other embodiments, the elastic ring 126 can be removed and the delay plate 147 can be biased into engagement with the fixing ring 127 to apply a drag force and to resist rotation of the support ring 123 and delay plate 147 about the spindle axis A with respect to the fixing ring 127 when a rotational force is applied to the spindle 28 to cause the spindle 28 to rotate relative to the driving connection. In these embodiments, frictional engagement between the delay plate 147 and the fixing ring 127 also resists rotation of the support ring 123 and delay plate 147 about the spindle axis A with respect to the fixing ring 127 when the rotational force is removed from the spindle 28.

In operation, when the motor M rotates the carrier 15 in the direction of arrow X, the protrusions 174 move along the camming surfaces of the release ring 121, causing the wedges 224 to move radially inwardly toward the releasing or unlocked position. As the wedges 224 move radially inwardly toward the releasing or unlocked position, the wedges 224 also pivot about the rollers 129 and relative to the spring plate 146 and the release ring 121. This releasing or unlocking function is accomplished within the free rotational angle α between the spindle 28 and the carrier 15 and the motor M.

After the locking structure is released or unlocked, the connecting part 32 of the carrier 15 and the connecting part 31 of the spindle 28 are moved into driving engagement so that the driving force of the carrier 15 (and motor M) is transferred to the spindle 28 and the spindle 28 rotates with the carrier 15 about the spindle axis A. In addition, when the locking structure is released or unlocked, each of the projections 143 is positioned in one recess (i.e., recess 142*a*, the "run" position recess).

When the motor M is stopped and rotation of the carrier 15 is stopped, rotation of the spindle 28 is controlled and buffered by the resilient force of the snap arms 144 retaining the projections 143 in the selected recesses (i.e., recess 142*a*). During stopping, if the inertia of the spindle 28 (and chuck 120 and/or the supported tool element) is less than the resilient force of the snap arms 144, rotation of the spindle 28 is stopped with the projections 143 being retained in the selected recess (i.e., recess 142*a*, the run position recess). In such a case, the resilient force of the snap arms 144 buffers and controls the inertia of the spindle 28 even when there is little or no relative rotation between the spindle 28 and the carrier 15 and the motor M. In addition, the delay plate 147 and the elastic ring 126 continuously apply a drag force to the drag surface 164 of the fixing ring 127, resisting rotation of the support ring 123 and the spindle 28 relative to the fixing ring 127. When the motor M is stopped, the drag force further buffers and controls the inertia of the spindle 28, slowing rotation of the spindle 28 relative to the fixing ring 127 and the housing 104.

When the inertia of the spindle 28 (and the chuck 120 and/or the tool element) is greater than the resilient force of the snap arms 144 and the drag force of the elastic ring 126 and the delay plate 147, the inertia overcomes the resilient force of the snap arms 144 and the drag force of the elastic ring 126 and the delay plate 147 so that the projections 143 move from one recess (i.e., recess 142*a*) to the other recess (i.e., recess 142*b*, the "lock" position recess). Movement of the projections 143 from one recess (i.e., recess 142*a*) to the other recess (i.e., recess 142*b*), resists the rotational inertia of the spindle 28 (and the chuck 120 and/or the tool element) and controls and buffers the rotational inertia of the spindle 28 (and the chuck 120 and/or the tool element) so that rotation of the spindle 28 is dissipated before the locking structure engages.

Therefore, the rotational inertia of the spindle 28 (and the chuck 120 and/or the tool element) is controlled and buffered by engagement of the projections 143 in the respective recesses (i.e., recesses 142*a*) and movement to the other recesses (i.e., recesses 142*b*) under the resilient spring force applied by the respective snap arms 144. The snap arms 144 also control the rotational force of the spindle 28 and delay the engagement of the wedges 224 and the locking wedge surfaces 137 so that there is no impact in the components of the spindle lock system 110, and no noise (no big "clunk") is created when rotation of the spindle 28 is stopped. Also, because the rotational force of the spindle 28 is controlled there is no impact of the spindle lock 110 and rebound through the free rotational angle α so that the "chattering" phenomenon is also avoided.

The spindle lock system 110 also prevents rotation of the spindle 128 (and the chuck 120 and/or the tool element) during replacement or adjustment of the tool element and corresponding adjustments to the chuck 120. More specifically, when the spindle lock 110 is in the locked condition, the wedges 224 are wedged between the locking surface 154 of the fixing ring 127 and the wedging surfaces 137 of the support ring 123 so that rotation of the spindle 28 in each rotational direction will be prevented. In constructions in which the wedges 224 include teeth 180 and the locking ring 127 includes teeth 156, such as the illustrated construction, the teeth 156 of the wedges 224 matingly engage corresponding teeth 156 of the locking ring 127 when the spindle lock system 110 is in the locked condition. Because the spindle 28 is prevented from rotating, the chuck 120 can be easily operated to remove and/or support the tool element.

When the motor M is restarted, the protrusions 174 of the wedges 224 move along the camming surfaces of the releasing apertures 144 (in the selected rotational direction), moving the wedges 224 to a releasing or unlocking position. After the wedges 224 are released, the spindle 28 is free to rotate about the spindle axis A.

When the spindle 28 is driven and the wedges 224 rotate about the spindle 28, the camming surfaces of the releasing apertures 141 maintain the wedges 224 in the respective unlocked or released positions and maintain the wedges 224 in an orientation in which the respective axes of the wedges 224 are substantially parallel to the axis A of the spindle 28. Such an engagement prevents the wedges 224 from becoming misaligned. The release ring 121 therefore provides an aligning feature for the wedges 224.

In cases in which the motor M is stopped and then restarted, the frictional engagement between the delay plate 147, the elastic ring 126 and the drag surface 164 of the fixing ring 127 delays relative rotation of the release ring 121 and the delay plate 147 about the axis A with respect to the fixing ring 127. After a short delay, rotational motion is transferred from the spindle 28 and the support ring 123 to the delay plate 147 and the releasing ring 121, causing the releasing ring 121 and the delay plate 147 to rotate about the axis A. The delay plate 147 then begins to rotate the wedges 224 circumferentially around the axis A by the engagement between the protrusions 174 of the wedges 224 and the walls of the egg-shaped apertures 131. By this engagement, the delay plate 147 forces the protrusions 174 circumferentially along the camming surfaces 141 of the releasing apertures 141 toward a releasing or unlocked position.

In constructions in which the wedges 224 have teeth 180 and the inner wall 152 of the fixing ring 127 has teeth 156, the rotational delay caused by the delay plate 147 and the elastic ring 126 orients the wedges 224 in the cavity 139 so that the teeth 180 of the wedges 224 are aligned with corresponding teeth 156 of the fixing ring 127. In this manner, when locking is reinitiated and the wedges 224 are forced radially outwardly by the wedging surfaces 137 of the support ring 123 and, in some cases, by the camming surfaces of the releasing ring 123, the teeth 180 of the wedges 224 are rapidly and easily moved into alignment and into mating engagement with corresponding teeth 156 of the fixing ring 124. Because the teeth 180 of the wedges 224 and the teeth 156 of the fixing ring 124 are aligned prior to initiation of locking, locking occurs more rapidly when locking is eventually initiated and the teeth 180 of the wedges 224 are prevented from skipping across the teeth 156 of the fixing ring 127 as can occur if the teeth 180 of the wedges 224 and the teeth 156 of the fixing ring 124 are misaligned.

Figure 32:
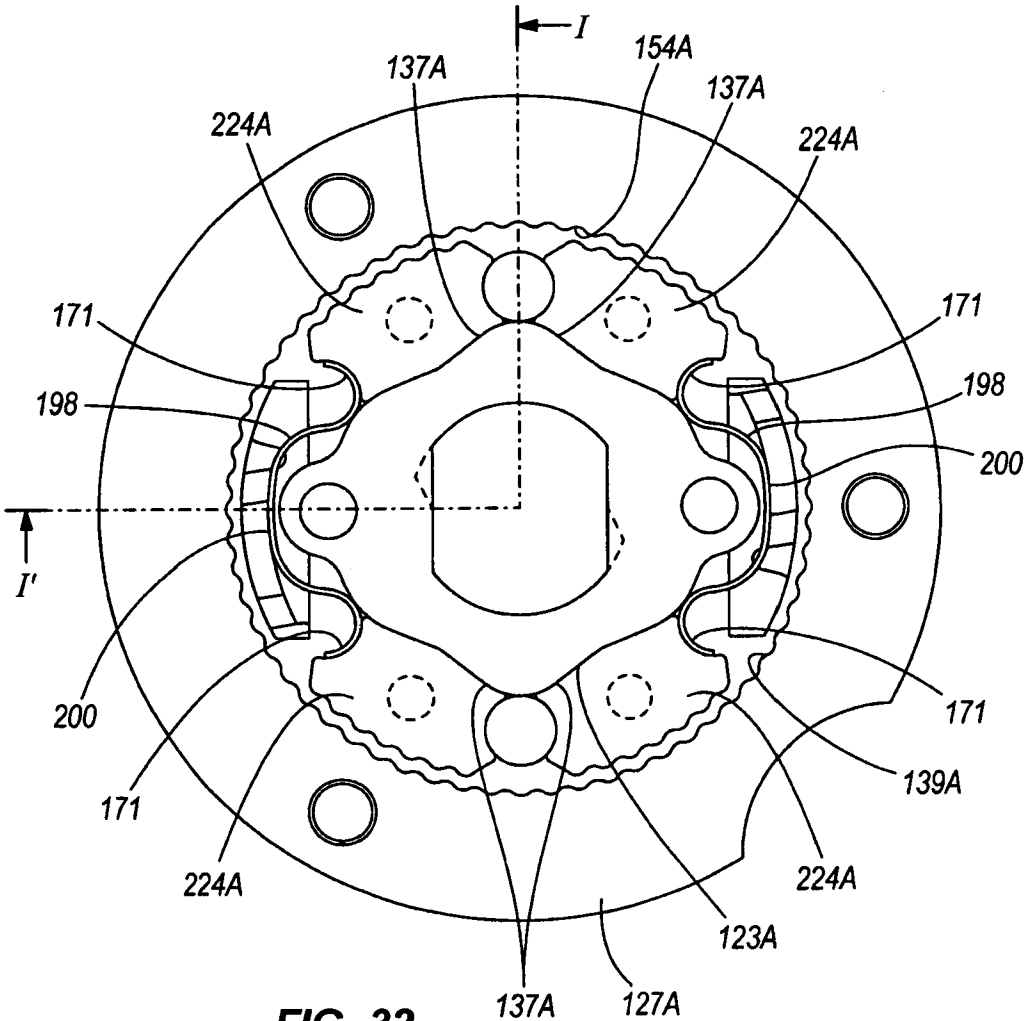
FIG. 32 is a front view of another alternate construction of a spindle lock system embodying aspects of the invention.

FIG. 32 illustrates an alternative construction for the wedges 224. Common elements are identified by the same reference number "A".

In the earlier-described construction, the wedges 224 are supported in the cavity 139 between the inner wall 152 of the fixing ring 127 and the wedging surfaces 137 of the support ring 123 for radial movement. In the alternative construction (shown in FIG. 32), the wedges 224A are supported in the cavity 139A by convex end parts 171 of springs 198. A concave base 200 of the springs 198 extends between the convex end parts 171 and is formed around a portion of the support ring 123A. In the illustrated construction of FIG. 32, the springs 198 are spaced circumferentially around the spindle axis A by about 180 degrees.

The convex end parts 171 of the springs 198 are received in correspondingly shaped concave end portions of the wedges 224A. The springs 198 apply a radially inward force to the wedges 224 to bias the wedges 224A radially inwardly toward the releasing or unlocked positions. During locking, the camming surfaces 123A apply a radially outward force to the wedges 224A sufficient to overcome the radially inward force of the springs 198 and sufficient to move the wedges 224 radially outwardly toward the locked positions, in which the wedges 224A lockingly engage the locking surface 154A of the fixing ring 127A.

FIGS. 33–44 illustrate another construction of the spindle lock system similar in many ways to the illustrated constructions of FIGS. 1–32 described above. Accordingly, with the exception of mutually inconsistent features and elements between the construction of FIGS. 33–44 and the constructions of FIGS. 1–32, reference is hereby made to the description above accompanying the constructions of FIGS. 1–32 for a more complete description of the features and elements (and the alternatives to the features and elements) of the construction of FIGS. 33–44. Features and elements in the construction of FIGS. 33–44 corresponding to features and elements in the constructions of FIGS. 1–32 are numbered in the 300 and 400 series.

Figure 33:
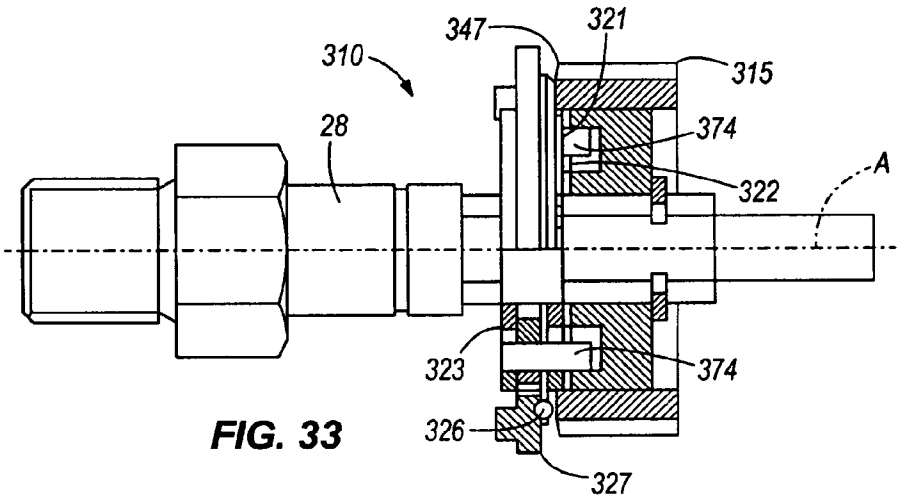
FIG. 33 is a partial cross-sectional side view of yet another alternate construction of a spindle lock system embodying aspects of the present invention.
Figure 34:
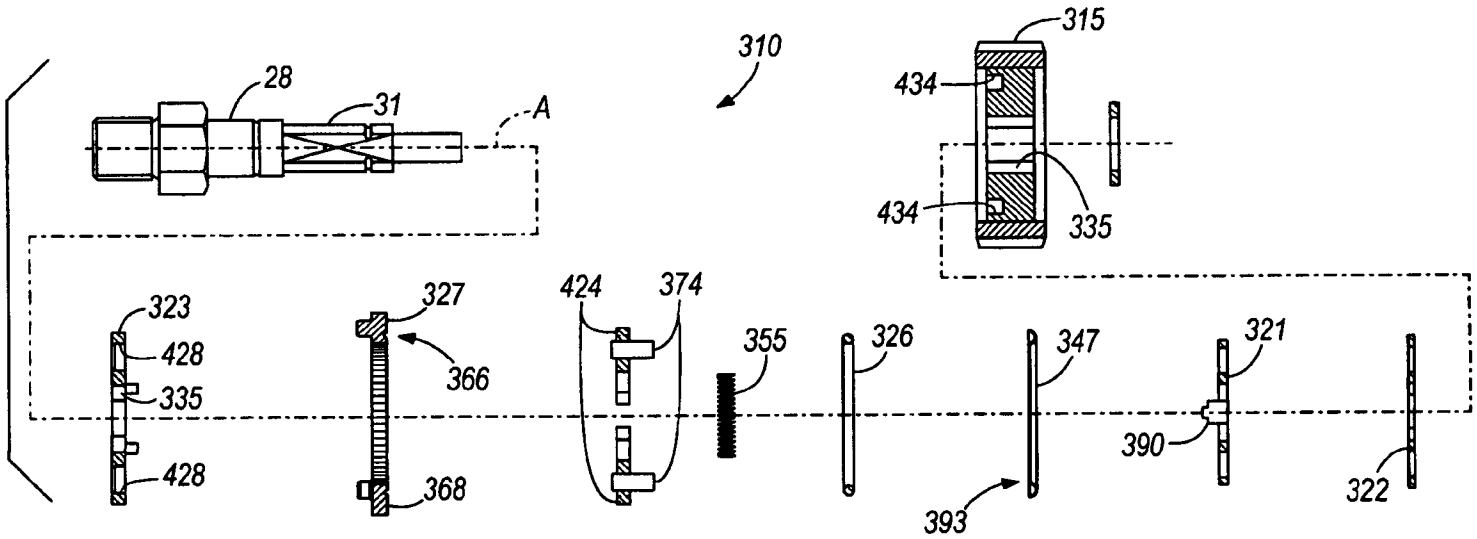
FIG. 34 is an exploded partial cross-sectional side view of the spindle lock system shown in FIG. 33.

As shown in FIGS. 33 and 34, the spindle lock system 310 is supportable on a spindle 28 of a power tool (e.g., the power tools 100, 200 or 300) and includes a driving engagement for conveying the output force of the motor M to the spindle 28. As described in greater detail below, the spindle lock system 310 also includes a locking structure for locking the spindle 28 and selectively preventing rotation of the spindle 28 relative to the housing 104 and relative to the carrier 315 and motor M.

Portions of the spindle lock system 310 may be similar to the lock device described in U.S. Pat. No. 6,010,426, issued Jan. 4, 2000, which is incorporated herein by reference. The illustrated locking structure may generally include a release ring 321, a driver or support ring 323, an elastic ring 326, a locking or fixing ring 327, a spring or snap ring 322, springs 355, a delay plate 347 and locking members or wedges 424. Each of the releasing ring 321, support ring 323, elastic ring 326, fixing ring 327, and delay plate 347 are generally in the shape of a ring extending about the same axis, such as the axis A of the spindle 28.

Figure 35:
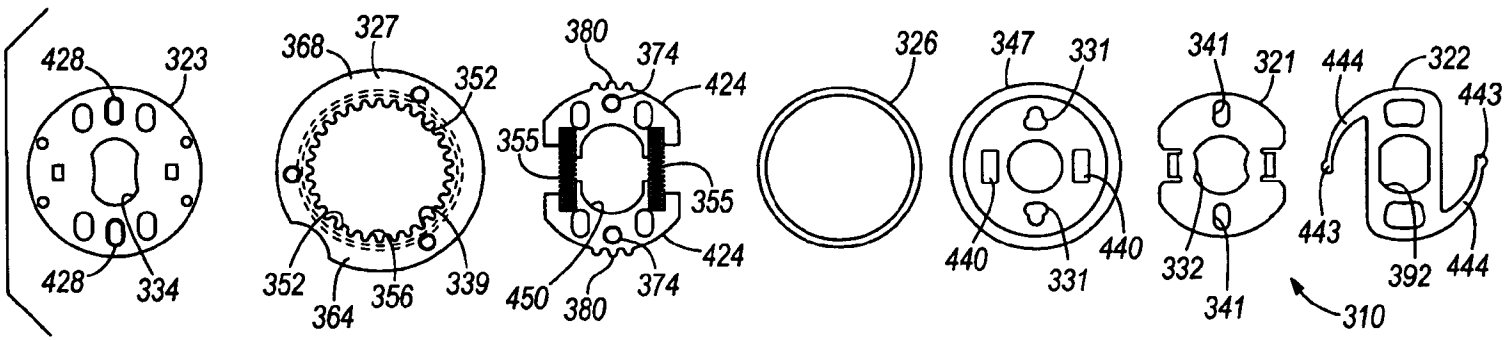
FIG. 35 is an exploded side view of the spindle lock system shown in FIG. 33.
Figure 36:
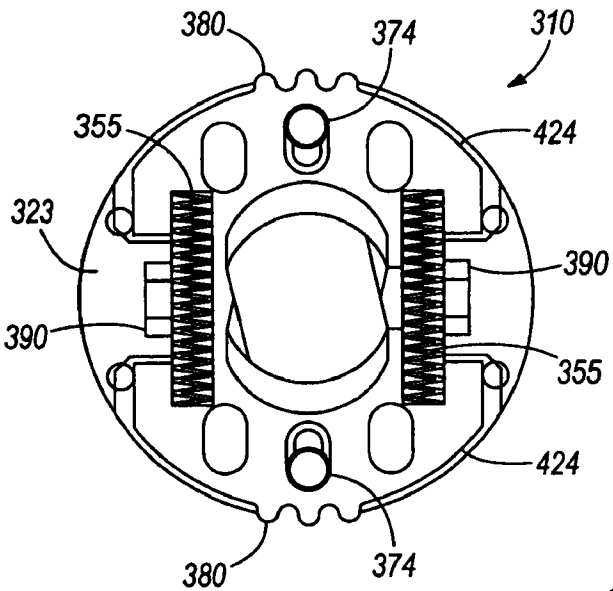
FIG. 36 is an enlarged front view of a portion of the spindle lock system shown in FIG. 33 in a locked position.
Figure 37:
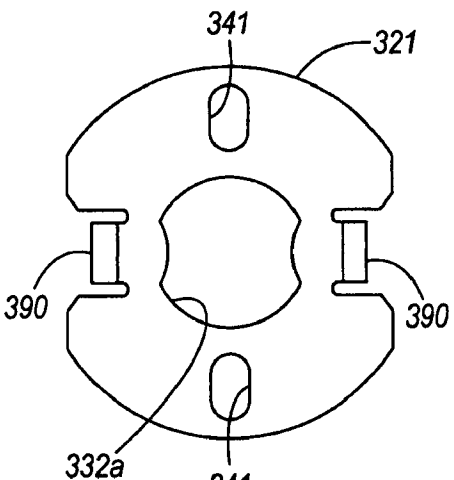
FIG. 37 is an enlarged front view of a release ring of the spindle lock system shown in FIG. 33.
Figure 38:
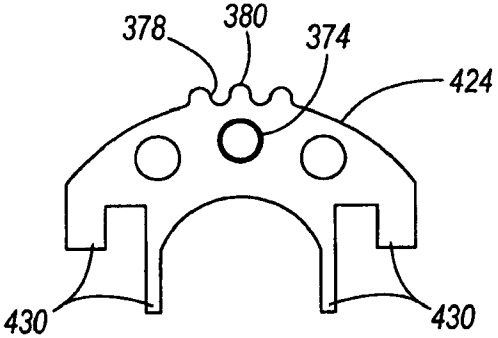
FIG. 38 is an enlarged front view of a wedge of the spindle lock system shown in FIG. 33.
Figure 39:
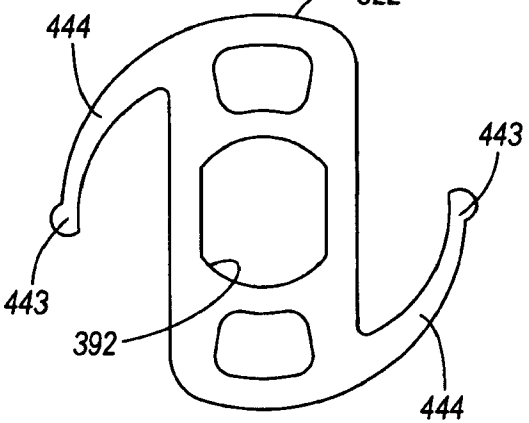
FIG. 39 is an enlarged front view of a snap ring of the spindle lock system shown in FIG. 33.
Figure 43:
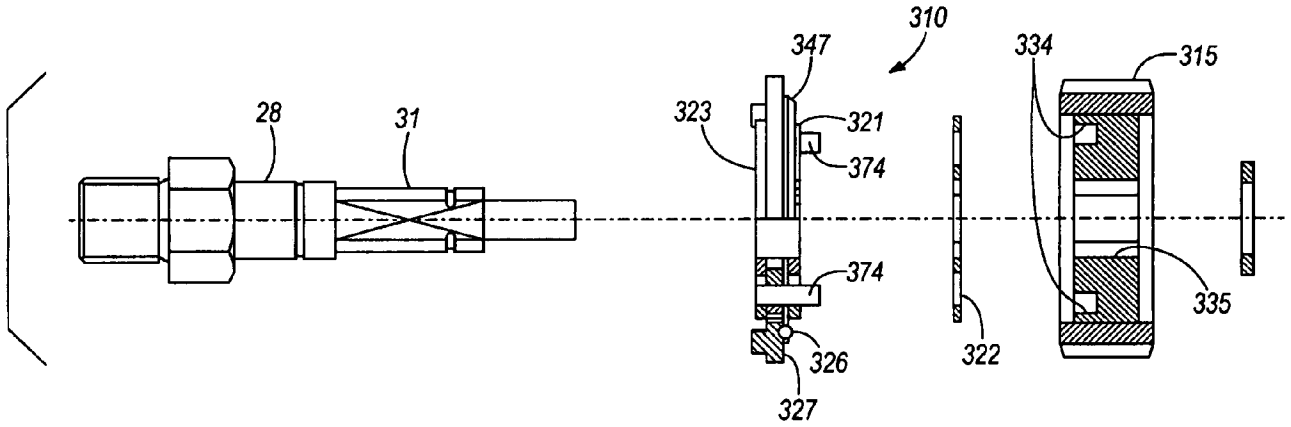
FIG. 43. is a partially exploded cross-sectional side view of the spindle lock system shown in FIG. 33.

The fixing ring 327 is securable in the housing 104 of a power tool to prevent movement of the fixing ring 327 with respect to the housing 104 (i.e., rotation about the spindle axis A). As shown in FIG. 35, an inner wall 352 of the fixing ring 327 defines a cavity 339 for receiving or supporting the wedges 424. In some aspects and in the illustrated construction, a number of teeth 356 are defined along the inner wall 352 and extend radially inwardly into the cavity 339.

As shown in FIG. 35, the support ring 323 includes a hole-shaped connecting part 334 which is engageable with the connector 31 on the spindle 28. In this manner, the support ring 323 is fixable to and rotatable with the spindle 28 as the spindle 28 rotates in the forward and reverse rotational directions, respectively. Elongated apertures 428 extend axially through the support ring 323 and are spaced circumferentially around the support ring 323 by about 180 degrees to correspond with the positions of wedges 424 in the cavity 339.

Two crescent shaped wedges 424 are supported in the cavity 339 for rotational motion about the axis A and for radial motion toward and away from the inner wall 352 of the fixing ring 327. Interior surfaces of the wedges 424 define a hole-shaped connecting part 450, which has a substantially similar configuration to the connector 31 of the spindle 28. More particularly, the hole-shaped connecting part 450 includes one or more flat sides (e.g., two, three, etc.) for engagement with one or more corresponding flat sides of the connector 31. In this manner, the wedges 424 are fixable to and rotatable with the spindle 28 as the spindle 28 rotates in the forward and reverse rotational directions, respectively.

Protrusions 374 extend axially from forward and rearward surfaces of the wedges 424. As shown in FIG. 33, rearward ends of the protrusions 374 extend axially through the elastic ring 326, delay plate 347, release ring 321, and snap ring 322 on opposite sides of the spindle axis A and are engaged and retained in releasing apertures 434 formed on the carrier 315 so that the delay plate 347, release ring 321, and snap ring 322 are fixed to and rotatable with the carrier 315. Forward ends of the protrusions 374 extend axially through the elongated apertures 428 in the support ring 323.

Radially outwardly facing sides 378 of the wedges 424 define locking surfaces and in some constructions, such as in the illustrated construction, include teeth 380. Radially inwardly facing sides of the wedges 424 include support arms 430 (see FIG. 38) which support springs 355. The springs 355 bias the wedges 424 radially outwardly toward securing or locking positions in which the teeth 380 of the wedges 424 lockingly engage corresponding teeth 356 of the locking ring 327.

The delay plate 347 is secured between the fixing ring 327 and the release ring 321 for rotation with the release ring 321 and the spindle 28 about the spindle axis A. As shown in FIG. 35, releasing apertures 331 extend axially through the delay plate 347 and define camming surfaces which extend along the outer periphery of the releasing apertures 331. The releasing apertures 331 are spaced circumferentially around the delay plate 347 by about 180 degrees to correspond with the relative positions of the wedges 424. Each camming surface is configured to release or unlock an associated wedge 424 by engagement with the protrusions 374 of the wedges 424 to force the wedges 424 radially inwardly toward the spindle axis A and out of engagement with the fixing ring 327. The circumferential length of each releasing aperture 331 is defined so that the releasing or unlocking function is accomplished within the free rotational angle $\alpha$ between the spindle 28 and the release ring 321.

A rear face 368 of the fixing ring 327 defines a drag surface 364 (see FIG. 34). The elastic ring or drag member 326 is supported in a groove 366 extending circumferentially around the rear face 368 of the fixing ring 327 and in a contoured pocket or recess 393 (see FIG. 34) formed in the delay plate 347. Frictional engagement between the elastic ring 326 and the fixing ring 327 resists rotation of the support ring 323, releasing ring 321 and delay plate 347 about the spindle axis A with respect to the fixing ring 327 when a rotational force is applied to the spindle 28 to cause the spindle 28 to rotate relative to the driving connection. Frictional engagement between the elastic ring 326 and the fixing ring 327 also resists rotation of the support ring 323, releasing ring 321 and delay plate 347 about the spindle axis A with respect to the fixing ring 327 when the rotational force is removed from the spindle 28.

In the illustrated construction, the elastic ring 326 is a substantially circular member made of an elastomeric material having a relatively smooth outer surface. In other constructions (not shown), the elastic ring 326 can include a thrust bearing and/or springs for biasing the elastic ring 326 into frictional engagement with the drag surface 364 of the fixing ring 327. In still other constructions, one or both of the elastic ring 326 and the drag surface 364 of the fixing ring 327 can include protrusions or fingers for frictional engagement in corresponding recesses or grooves located along the other of the elastic ring 326 and the drag surface 364 of the fixing ring 327. In other constructions, one or both of the elastic ring 326 and the drag surface 364 of the fixing ring 327 can include textured (e.g., knurled, contoured, ribbed, etc.) outer surfaces.

In yet other embodiments, the elastic ring 326 can be removed and the delay plate 347 can be biased into engagement with the fixing ring 327 to apply a drag force and to resist rotation of the support ring 323, releasing ring 321 and delay plate 347 about the spindle axis A with respect to the fixing ring 327 when a rotational force is applied to the spindle 28 to cause the spindle 28 to rotate relative to the driving connection. In these embodiments, frictional engagement between the delay plate 347 and the fixing ring 327 also resists rotation of the support ring 323, releasing ring 321 and delay plate 347 about the spindle axis A with respect to the fixing ring 327 when the rotational force is removed from the spindle 28.

The release ring 321 defines a hole-shaped connector 332 which is substantially identical to the connector 335 formed in the carrier 315 to provide the free rotational angle $\alpha$ between the spindle 28 and the carrier 315 and the release ring 321. Egg-shaped apertures 341 extend axially through the release ring 321 and are separated by about 180 degrees to correspond with the relative positions of the wedges 424. Legs 390 extend axially from a forward side of the release ring 321 through apertures 440 in the delay plate 347 and into the cavity 339 of the fixing ring 327. The legs 390 are spaced circumferentially around the release ring 321 by about 180 degrees and are secured to the rearward face of the support ring 323.

The releasing apertures 331, the egg-shaped apertures 341 and the elongated apertures 428 and the circumferential spacing of the releasing apertures 331 around the delay plate 347, the circumferential spacing of the egg-shaped apertures 341 around the release ring 321 and the circumferential spacing of the elongated apertures 428 around the support plate 323 synchronize movement of the wedges 424 so that the wedges 424 move together between respective locked or retaining positions and unlocked or releasing positions. The releasing apertures 331, the egg-shaped apertures 341 and the elongated apertures 428 also maintain the relative orientation of the wedges 424 with respect to the fixing ring 327. More specifically, the engagement of the protrusions 374 and the releasing apertures 331, egg-shaped apertures 341 and elongated apertures 428 maintains the wedges 424 in an orientation in which wedge axes extending through the protrusions 374 of the wedges 424 are substantially parallel to the spindle axis A.

By their engagement with the protrusions 374 of the wedges 424, the elongated apertures 428 of the support ring 323 and the egg-shaped apertures 341 of the release ring 321 cooperate with the releasing apertures 331 of the delay plate 347 to wedge the wedges 424 in place in respective locked or retaining positions which correspond to a locked condition of the spindle lock system 310, in which the spindle 28 is prevented from rotating relative to the housing 104 and relative to the motor M and carrier 315. During releasing or unlocking, the camming surfaces of the releasing apertures 331 and, in some constructions, the releasing apertures 434 (described below) of the carrier 315 move the wedges 424 radially inwardly and out of engagement with the inner wall 352 of the fixing ring 327 and toward the spindle axis A to a releasing or unlocked position which corresponds to an unlocked condition of the spindle lock system 110, in which the spindle 28 is free to rotate relative to the housing 104. In addition, the releasing apertures 331 have a circumferential dimension allowing the wedges 424 to be supported in the releasing or unlocked position.

Figure 44:
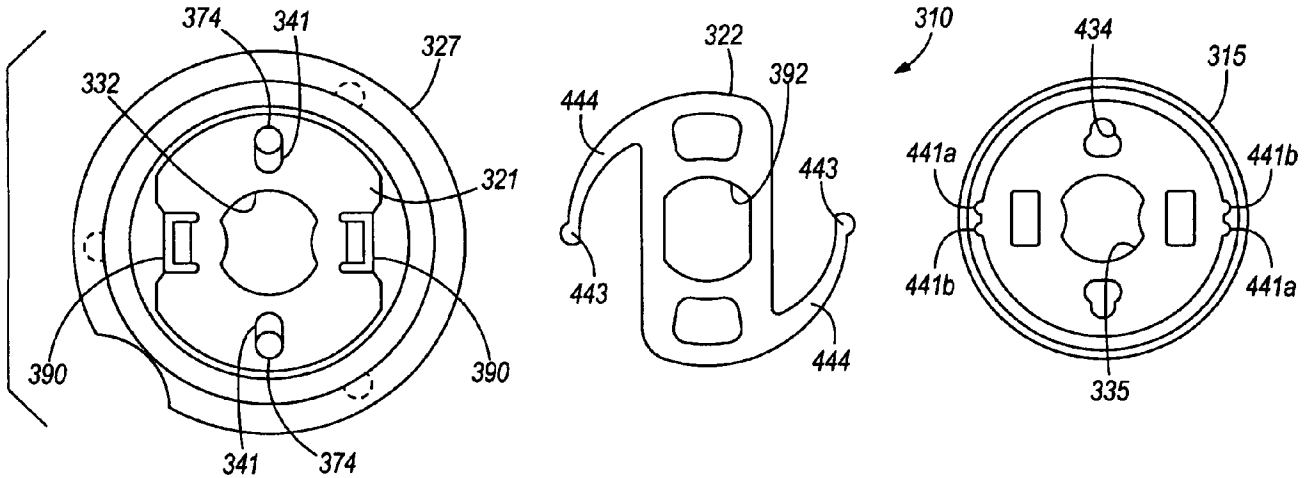
FIG. 44 is an exploded side view of the spindle lock system shown in FIG. 33.

As shown in FIG. 44, the carrier 315 defines a hole-shaped connector 335 which is substantially identical to both the connector 334 formed in the support ring 323 and the connector 332 formed in the release ring 321 to provide the free rotational angle $\alpha$ between the spindle 28 and the carrier 315 and the release ring 321. Releasing apertures 434 extend axially through a portion of the carrier 315 and define camming surfaces which extend along the outer periphery of the releasing apertures 434. The releasing apertures 434 are spaced circumferentially around the carrier 315 by about 180 degrees to correspond with the relative positions of the wedges 424. Each camming surface is configured to cooperate with the camming surfaces of the delay plate 347 to release or unlock an associated wedge 424 by engagement with the protrusions 374 of the wedge 424 to force the wedge 424 radially inwardly toward the spindle axis A and out of engagement with the fixing ring 327. The circumferential length of each releasing aperture 434 is defined so that the releasing or unlocking function is accomplished within the free rotational angle $\alpha$ between the spindle 28 and the carrier 315.

Figure 42:
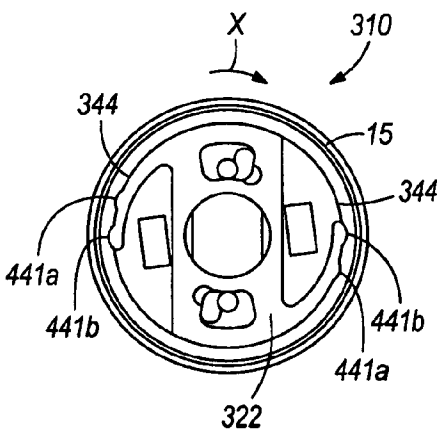
FIG. 42 is a rear view of the spindle lock system shown in FIG. 33 in an unlocked position.
Figure 41:
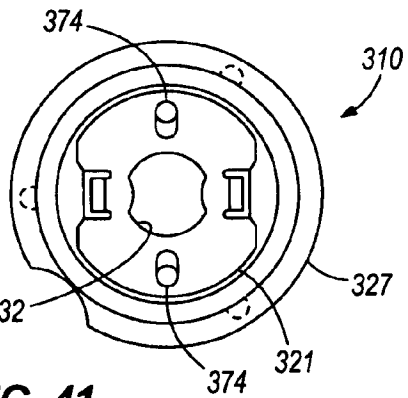
FIG. 41 is a rear view of the spindle lock system shown in FIG. 33 with the snap ring removed.
Figure 40:
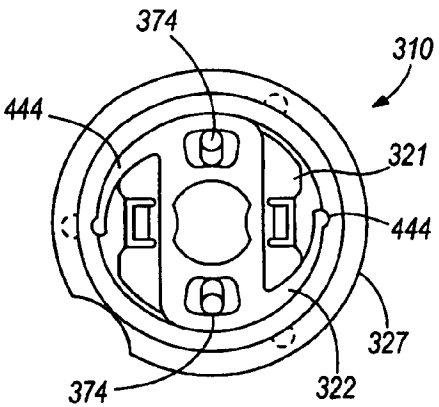
FIG. 40 is a rear view of the spindle lock system shown in FIG. 33 in a locked position.

As shown in FIGS. 42 and 44, two pairs of recesses 441 are formed on the forward side of the carrier 315 and, in the illustrated construction, are equally separated around the circumference of the carrier 315 by about 180 degrees. Each pair of recesses 441 defines one portion of a detent arrangement or controlling structure for controlling the resilient force of the snap ring 322 between a detent position corresponding to an unlocked condition of the spindle lock system 310 and a detent position corresponding to the locked condition of the spindle lock system 310.

The snap ring 322 is supported on the rear face of the release ring 321 and includes springs or snap arms 444 each having a controlling convex projection 443 formed at its free end. The projections 443 provide the other portion of the detent arrangement and are selectively engageable in one of a pair of corresponding recesses 441. The snap ring 322 provides a resilient force to bias the projections 443 into engagement with a selected one of the recesses 441. The resilient spring force on the projections 443 is provided by the elasticity and material characteristics of the snap arms 444.

A hole-shaped connecting part 392 extends axially through a central portion of the snap ring 322 and has a substantially similar configuration to the connector 31 on the spindle 28. More particularly, the hole-shaped connecting part 392 includes one or more flat sides (e.g., one, two, three, etc.) for engagement with one or more corresponding flat sides of the connector 31. In this manner, the snap ring 322 is fixable to and rotatable with the spindle 28 as the spindle 28 rotates in the forward and reverse rotational directions, respectively.

The resilient force of the snap arms 444 is smaller than the drive force of the motor M and will allow the projections 443 to move from one recess (i.e., recess 441*b*) to the other recess (i.e., recess 441*a*) when the motor M is restarted. The resilient force the snap arms 444 apply to the projections 443 is selected to allow the projections 443 to move from one recess (i.e., 441*a*) to the other recess (i.e., 441*b*) to control and buffer the rotational force of the spindle 28 when the motor M is stopped and to delay the engagement of the locking structure.

In operation, when the motor M rotates the carrier 315 in the direction of arrow X (see FIG. 42), the protrusions 374 move along the camming surfaces of the delay plate 347 and the carrier 315, causing the wedges 424 to move radially inwardly toward the releasing or unlocked position. This releasing or unlocking function is accomplished within the free rotational angle α between the spindle 28 and the carrier 315 and the motor M.

After the locking structure is released or unlocked, the connecting part 335 of the carrier 315 and the connecting part 31 of the spindle 28 are moved into driving engagement so that the driving force of the carrier 315 (and motor M) is transferred to the spindle 28 and the spindle 28 rotates with the carrier 315 about the spindle axis A. In addition, when the locking structure is released or unlocked, each of the projections 343 is positioned in one recess (i.e., recess 441*a*, the "run" position recess).

When the motor M is stopped and rotation of the carrier 315 is stopped, rotation of the spindle 28 is controlled and buffered by the resilient force of the snap arms 444 retaining the projections 443 in the selected recesses (i.e., recess 441*a*). During stopping, if the inertia of the spindle 28 (and chuck 120 and/or the supported tool element) is less than the resilient force of the snap arms 444, rotation of the spindle 28 is stopped with the projections 443 being retained in the selected recess (i.e., recess 441*a*, the run position recess). In such a case, the resilient force of the snap arms 444 buffers and controls the inertia of the spindle 28 even when there is little or no relative rotation between the spindle 28 and the carrier 315 and the motor M. In addition, the delay plate 347 and the elastic ring 326 continuously apply a drag force to the drag surface 364 of the fixing ring 327, resisting rotation of the support ring 323, releasing ring 321, delay plate 347, snap ring 322 and the spindle 28 relative to the fixing ring 327. When the motor M is stopped, the drag force further buffers and controls the inertia of the spindle 28, slowing rotation of the spindle 28 relative to the fixing ring 327 and the housing 104.

When the inertia of the spindle 28 (and the chuck 120 and/or the tool element) is greater than the resilient force of the snap arms 444 and the drag force of the elastic ring 326 and the delay plate 347, the inertia overcomes the resilient force of the snap arms 444 and the drag force of the elastic ring 326 and the delay plate 347 so that the projections 443 move from one recess (i.e., recess 441*a*) to the other recess (i.e., recess 441*b*, the "lock" position recess). Movement of the projections 443 from one recess (i.e., recess 441*a*) to the other recess (i.e., recess 441*b*), resists the rotational inertia of the spindle 28 (and the chuck 120 and/or the tool element) and controls and buffers the rotational inertia of the spindle 28 (and the chuck 120 and/or the tool element) so that rotation of the spindle 28 is dissipated before the locking structure engages.

Therefore, the rotational inertia of the spindle 28 (and the chuck 120 and/or the tool element) is controlled and buffered by engagement of the projections 443 in the respective recesses (i.e., recesses 441*a*) and movement to the other recesses (i.e., recesses 441*b*) under the resilient spring force applied by the respective snap arms 444. The snap arms 444 also control the rotational force of the spindle 28 and delay the engagement of the protrusions 374 and the camming surfaces of the delay plate 347 and the carrier 315 so that there is no impact in the components of the spindle lock system 310, and no noise (no big "clunk") is created when rotation of the spindle 28 is stopped. Also, because the rotational force of the spindle 28 is controlled there is no impact of the spindle lock 110 and rebound through the free rotational angle α so that the "chattering" phenomenon is also avoided.

The spindle lock system 310 also prevents rotation of the spindle 128 (and the chuck 120 and/or the tool element) during replacement or adjustment of the tool element and corresponding adjustments to the chuck 120. More specifically, when the spindle lock 310 is in the locked condition, the springs 355 force the wedges 424 radially outwardly into locking engagement with the locking surface 354 of the fixing ring 327 so that rotation of the spindle 28 in each rotational direction will be prevented. In constructions in which the wedges 424 include teeth 380 and the locking ring 327 includes teeth 356, such as the illustrated construction, the teeth 356 of the wedges 424 matingly engage corresponding teeth 356 of the locking ring 327 when the spindle lock system 310 is in the locked condition. Because the spindle 28 is prevented from rotating, the chuck 120 can be easily operated to remove and/or support the tool element.

When the motor M is restarted, the protrusions 374 of the wedges 424 move along the camming surfaces of the releasing apertures 331 and 434 (in the selected rotational direction), moving the wedges 424 to a releasing or unlocking position. After the wedges 424 are released, the spindle 28 is free to rotate about the spindle axis A.

In cases in which the motor M is stopped and then restarted, the frictional engagement between the delay plate 347, the elastic ring 326 and the drag surface 364 of the fixing ring 327 delays relative rotation of the release ring 321, delay plate 347 and support ring 323 about the axis A with respect to the fixing ring 327. After a short delay, rotational motion is transferred from the spindle 28 to the release ring 321, delay plate 347 and support ring 323, causing the release ring 321, delay plate 347 and support ring 323 to rotate about the axis A. The releasing ring 321 and the support ring 323 then begin to rotate the wedges 424 circumferentially around the axis A by the engagement between the protrusions 374 of the wedges 424 and the walls of the egg-shaped apertures 341 and the engagement between the protrusions 374 of the wedges 424 and the walls of the elongated apertures 448. By this engagement, the releasing ring 321 and the support ring 323 force the protrusions 374 circumferentially along the camming surfaces of the releasing apertures 331 and 434 toward a releasing or unlocked position.

In constructions in which the wedges 424 have teeth 380 and the inner wall 352 of the fixing ring 327 has teeth 356, the rotational delay caused by the delay plate 347 and the elastic ring 326 orients the wedges 424 in the cavity 339 so that the teeth 380 of the wedges 424 are aligned with corresponding teeth 356 of the fixing ring 327. In this manner, when locking is reinitiated, the teeth 380 of the wedges 424 are rapidly and easily moved into alignment and into mating engagement with corresponding teeth 356 of the fixing ring 327. Because the teeth 380 of the wedges 424 and the teeth 356 of the fixing ring 327 are aligned prior to initiation of locking, locking occurs more rapidly when locking is eventually initiated and the teeth 380 of the wedges 424 are prevented from skipping across the teeth 356 of the fixing ring 327 as can occur if the teeth 380 of the wedges 424 and the teeth 356 of the fixing ring 327 are misaligned.

It should be understood that components of the constructions illustrated in FIGS. 1–19 and FIGS. 20–44 may be substituted for one another.

One or more independent features of the present invention are set forth in the following claims.

We claim:

1. A spindle lock for a power tool, the power tool including a housing, a motor supported by the housing and including a motor shaft, and a spindle supported by the housing for rotation about an axis, a driving connection being provided between the spindle and the motor shaft such that the spindle is drivingly connectable to the motor shaft, the spindle being selectively driven by the motor in a first direction about the axis and in a second direction about the axis, the second direction being opposite to the first direction, said spindle lock comprising:

a first locking member defining a first locking surface;

a second locking member defining a second locking surface;

a wedge positioned between the first locking member and the second locking member and positionable in a locked position, in which the wedge is wedged between the first locking surface and the second locking surface to prevent rotation of the spindle, and in an unlocked position;

a spring operable to delay movement of the wedge from the unlocked position to the locked position and being flexible in a direction generally parallel to the axis when a force is applied to the spindle to cause the spindle to rotate relative to the driving connection; and a detent arrangement including a first recess and a second recess, and a projection engaged by the spring, the projection being selectively positioned in the first recess and in the second recess;

wherein, when the spindle is rotated in the first direction relative to the driving connection, the projection is movable between a first position, which corresponds to the unlocked position of the wedge and in which the projection is positioned in the first recess, and a second position, in which the projection is positioned in the second recess, movement of the projection from the first recess delaying movement of the wedge from the unlocked position to the locked position when the spindle is rotated in the first direction relative to the driving connection; and wherein, when the spindle is rotated in the second direction relative to the driving connection, the projection is movable between the second position, which corresponds to the unlocked position of the wedge and in which the projection is positioned in the second recess, and the first position, in which the projection is positioned in the first recess, movement of the projection from the second recess delaying movement of the wedge from the unlocked position to the locked position when the spindle is rotated in the second direction relative to the driving connection.

2. The spindle lock of claim 1, wherein the wedge and at least one of the first and second locking members include inter-engaging teeth engageable to prevent rotation of the spindle when the wedge is in the locked position.

3. The spindle lock of claim 1, wherein the wedge defines a wedge axis, and wherein the spindle lock further comprises an alignment member engageable with the wedge to maintain the wedge in an orientation in which the wedge axis is parallel to the spindle axis.

4. The spindle lock of claim 3, wherein the wedge has an outer surface and a length, wherein the first locking surface and the second locking surface extend parallel to the spindle axis, and wherein the alignment member maintains the wedge in an orientation in which the wedge axis is parallel to the first locking surface and the second locking surface such that, in the locked position, a first portion of the outer surface engages the first locking surface along a substantial portion of the length of the wedge and a second portion of the outer surface engages the second locking surface along a substantial portion of the length of the wedge.

5. The spindle lock of claim 3, wherein the alignment member defines a camming surface, at least a portion of the wedge being cammingly engageable with the camming surface for movement between the locked position and the unlocked position.

6. The spindle lock of claim 1, further comprising:

a second wedge positioned between the first locking member and the second locking member and positionable in a locked position, in which the wedge is wedged between the first locking surface and the second locking surface to prevent rotation of the spindle, and in an unlocked position; and a synchronizing member engageable with the first-mentioned wedge and the second wedge such that the first-mentioned wedge and the second wedge simultaneously move to the respective locked positions.

7. The spindle lock of claim 1, when the spindle is rotated in the first direction relative to the motor shaft, the spring applies a first spring force to the projection to bias the projection into the first recess and to delay movement of the second locking member from the unlocked position to the locked position, and wherein, when the spindle is rotated in the second direction relative to the motor shaft, the spring applies a second spring force to the projection to bias the projection into the second recess and to delay movement of the second locking member from the unlocked position to the locked position, the second spring force and the first spring force being substantially equal.

8. The spindle lock of claim 1, further comprising a second spring positioned between the wedge and the first locking surface, the second spring biasing the wedge toward the unlocked position.

9. The spindle lock of claim 1, wherein the first locking member defines a drag surface, and wherein the spindle lock further comprises a drag element positioned adjacent to the drag surface and being engageable with the drag surface to resist rotation of the second locking member about the axis and relative to the first locking member.

10. A spindle lock for a power tool, the power tool including a housing, a motor supported by the housing and including a motor shaft, and a spindle supported by the housing for rotation about an axis, a driving connection being provided between the spindle and the motor shaft such that the spindle is drivingly connectable to the motor shaft, the spindle being selectively driven by the motor in a first direction about the axis and in a second direction about the axis, the second direction being opposite to the first direction, said spindle lock comprising:

a first locking member;

a second locking member movable between a locked position, in which the second locking member engages the first locking member to prevent rotation of the spindle, and an unlocked position;

a spring operable to delay movement of the second locking member from the unlocked position to the locked position when a force is applied to the spindle to cause the spindle to rotate relative to the driving connection, the spring including a first recess and a second recess; and a projection being engaged by the spring, at least a portion of the projection being selectively positioned in the first recess and the second recess;

wherein, when the spindle is rotated in the first direction relative to the driving connection, the projection is movable between a first position, which corresponds to the unlocked position of the second locking member and in which the projection is positioned in the first recess, and a second position, in which the projection is positioned in the second recess, movement of the projection from the first recess delaying movement of the second locking member from the unlocked position to the locked position when the spindle is rotated in the first direction relative to the driving connection; and wherein, when the spindle is rotated in the second direction relative to the driving connection, the projection is movable between the second position, which corresponds to the unlocked position of the second locking member and in which the projection is positioned in the second recess, and the first position, in which the projection is positioned in the first recess, movement of the projection from the second recess delaying movement of the second locking member from the unlocked position to the locked position when the spindle is rotated in the second direction relative to the driving connection.

11. The spindle lock of claim 10, wherein, when the spindle is rotated in the first direction relative to the motor shaft, the spring applies a first spring force to the projection to bias the projection into the first recess and to delay movement of the second locking member from the unlocked position to the locked position, and wherein, when the spindle is rotated in the second direction relative to the motor shaft, the spring applies a second spring force to the projection to bias the projection into the second recess and to delay movement of the second locking member from the unlocked position to the locked position, the second spring force and the first spring force being substantially equal.

12. The spindle lock of claim 10, wherein the spring applies a spring force to the projection to bias the projection into a selected one of the first recess and the second recess.

13. The spindle lock of claim 12, wherein the spring applies the spring force to the projection in an axial direction to bias the projection into the selected one of the first recess and the second recess.

14. The spindle lock of claim 12, wherein, when the spindle is rotated in the first direction, the second position of the projection corresponds to the locked position of the second locking member, and wherein, when the spindle is rotated in the first direction, the projection engages the second recess to releasably maintain the second locking member in the locked position.

15. The spindle lock of claim 14, wherein, when the spindle is rotated in the second direction, the first position of the projection corresponds to the locked position of the second locking member, and wherein, when the spindle is rotated in the second direction the projection engages the first recess to releasably maintain the second locking member in the locked position.

16. The spindle lock of claim 10, further comprising a second spring positioned adjacent to the second locking member, the second spring biasing the wedge toward the unlocked position, the wedge being movable toward the locked position when a force is applied to the spindle to cause the spindle to rotate relative to the driving connection in the first direction about the axis.

17. A spindle lock for a power tool, the power tool including a housing, a motor supported by the housing and including a motor shaft, and a spindle supported by the housing for rotation about an axis, a driving connection being provided between the spindle and the motor shaft such that the spindle is drivingly connectable to the motor shaft, the spindle lock comprising:

a first locking member defining a first locking surface and a drag surface;

a second locking member movable between a locked position, in which the second locking member engages the first locking member to prevent rotation of the spindle, and an unlocked position;

a drag element positioned adjacent to the drag surface and being engageable with the drag surface to resist rotation of the second locking member with respect to the first locking member when a force is applied to the spindle to cause the spindle to rotate relative to the driving connection and when the force is removed from the spindle; and a delay plate positioned adjacent to the first locking member and operable to apply an axial force to the drag element and the drag surface and to resist rotation of the second locking member with respect to the first locking member.

18. The spindle lock of claim 17, wherein the first locking member defines a groove extending circumferentially around the drag surface, the groove housing at least a portion of the drag element.

19. The spindle lock of claim 18, wherein the delay plate positioned adjacent to the first locking member has a contoured recess, the drag element being housed in the groove and in the contoured recess of the delay plate.

20. The spindle lock of claim 17, wherein the first and second locking surfaces include inter-engaging teeth, resistance between the drag element and the drag surface delaying rotation of the second locking member with respect to the first locking member and aligning the teeth of the second locking surface with the teeth of the first locking surface.

* * * * *